US005276947A

United States Patent [19]

Fritschi et al.

[11] Patent Number: 5,276,947

[45] Date of Patent: Jan. 11, 1994

[54] DEVICE FOR THE TRANSPORTION OF CANS BETWEEN MACHINES OR DEVICES TREATING OR PROCESSING FIBER SLIVERS

[75] Inventors: Isidor Fritschi, Andelfingen, Switzerland; Michael Ueding, Ingolstadt, Fed. Rep. of Germany

[73] Assignee: Schubert & Salzer Maschinenfabrik AG, Ingolstadt, Fed. Rep. of Germany

[21] Appl. No.: 807,855

[22] PCT Filed: May 17, 1990

[86] PCT No.: PCT/DE91/00410

§ 371 Date: Jan. 14, 1992

§ 102(e) Date: Jan. 14, 1992

[87] PCT Pub. No.: WO91/18135

PCT Pub. Date: Nov. 28, 1991

[30] Foreign Application Priority Data

May 18, 1990 [DE] Fed. Rep. of Germany ..... 4015938
Nov. 8, 1990 [DE] Fed. Rep. of Germany ..... 4035439

[51] Int. Cl.[5] ..... D04H 11/00

[52] U.S. Cl. ..... 19/159 A; 57/281; 57/90

[58] Field of Search ..... 19/159; 57/281, 276, 57/90; 364/470, 478; 414/339, 352, 429, 467, 539, 495, 650, 591

[56] References Cited

U.S. PATENT DOCUMENTS

| | | | |
|---|---|---|---|
| 3,443,287 | 5/1969 | Hertzsch | 19/159 A |
| 4,012,893 | 3/1977 | Weber | 57/281 |
| 4,078,369 | 3/1978 | Brandis | 57/90 |
| 4,150,534 | 4/1979 | Raasch . | |
| 4,227,848 | 10/1980 | Kriechbaum et al. | 19/159 A |
| 4,697,310 | 10/1987 | Raasch | 19/159 A |
| 4,735,040 | 4/1988 | Pircher | 19/159 A |
| 4,987,649 | 1/1991 | Meyer et al. | 19/159 A |
| 5,138,828 | 8/1992 | Stahlecker | 57/281 |

FOREIGN PATENT DOCUMENTS

| | | |
|---|---|---|
| 0069087 | 1/1983 | European Pat. Off. . |
| 0371417 | 6/1990 | European Pat. Off. . |
| 1044686 | 5/1959 | Fed. Rep. of Germany . |
| 8606358 | 11/1986 | Fed. Rep. of Germany . |
| 3524922 | 1/1987 | Fed. Rep. of Germany . |
| 8812622 | 3/1990 | Fed. Rep. of Germany . |
| 4018088 | 1/1991 | Fed. Rep. of Germany . |
| 2587042 | 3/1987 | France . |
| 2587043 | 3/1987 | France . |
| 2610235 | 5/1988 | France . |
| 2171121 | 2/1986 | United Kingdom . |

*Primary Examiner*—Clifford D. Crowder
*Assistant Examiner*—Michael A. Neas
*Attorney, Agent, or Firm*—Dority & Manning

[57] ABSTRACT

A process for the transportation of cans between machines processing fiber slivers by means of a can conveying device. The latter is loaded and unloaded simultaneously in one position at a machine or storage facility. The cans are inspected during their transportation between two such machines. In this process, the cans in which fiber sliver remnants remain, are emptied. The route of the can conveying device constitutes a transportation system consisting of three interconnected can circuits, whereby a first can circuit comprises two such machines and the other two can circuits each comprise one of these machines and the can storage facility. The can shifting device, to load and unload the can conveying device is equipped with a grasping device to grasp the can and with a lifting device to lift up the grasped can. The gasping device is located on a sled that can be shifted perpendicularly to the longitudinal extension of the can conveying device which is, in turn, located on a supporting sled capable of moving at a perpendicular to the longitudinal extension of the can conveying device.

17 Claims, 18 Drawing Sheets

FIG. 11
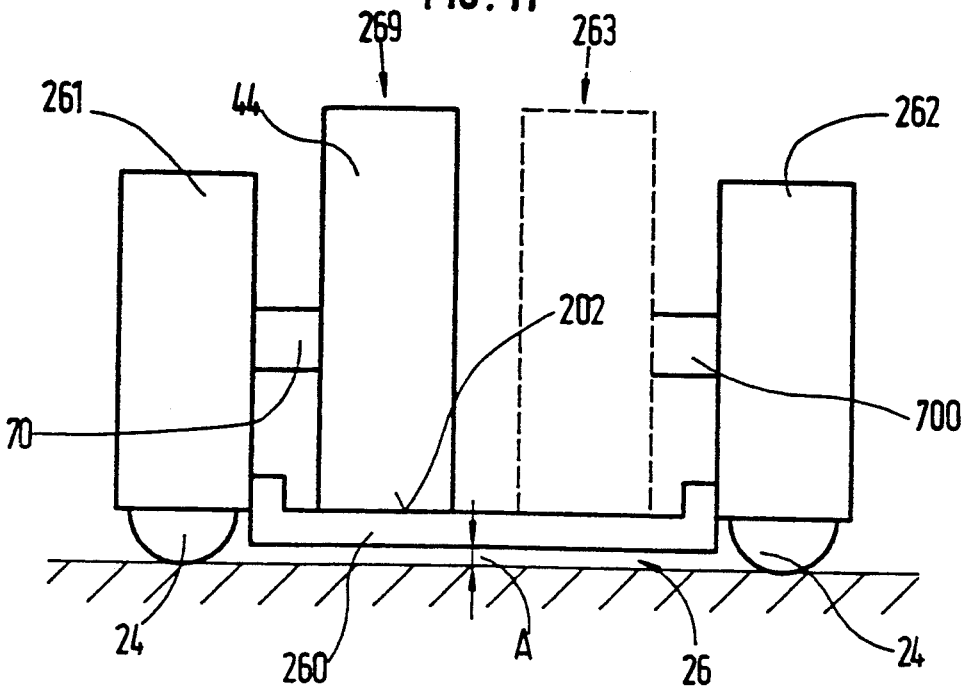
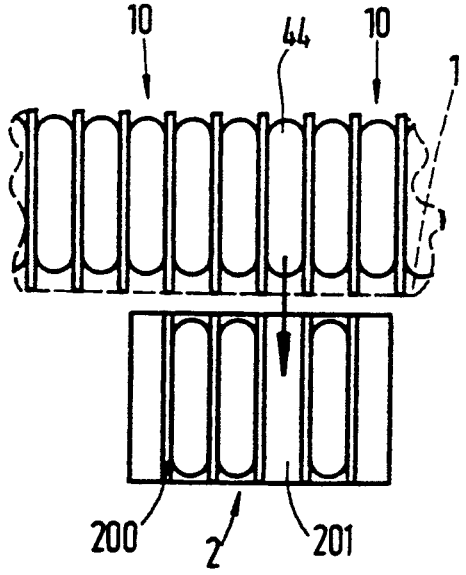
FIG. 12
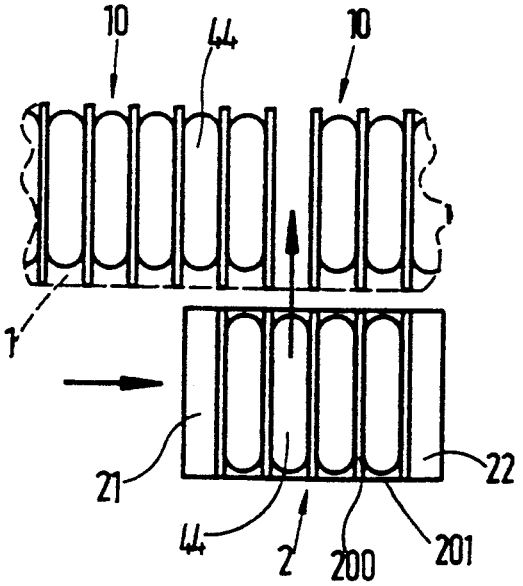
FIG. 13

FIG. 17
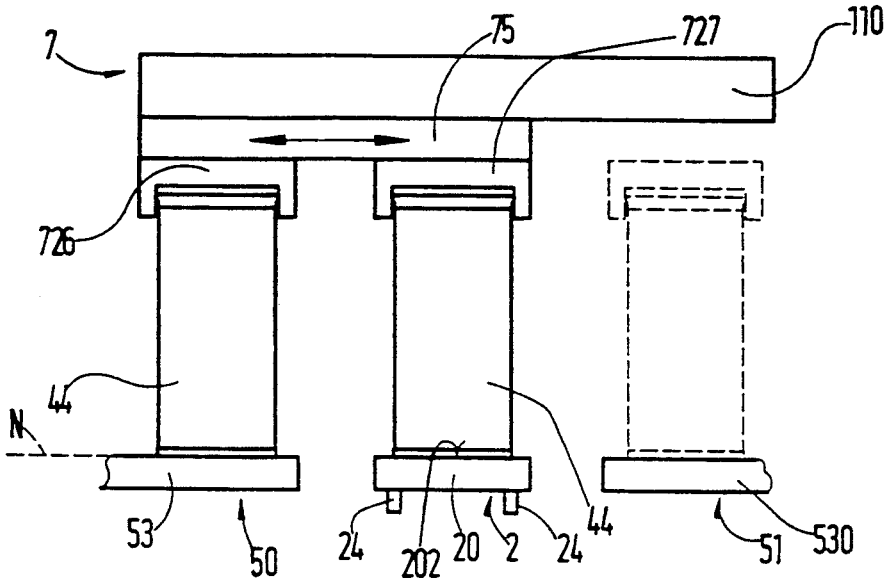
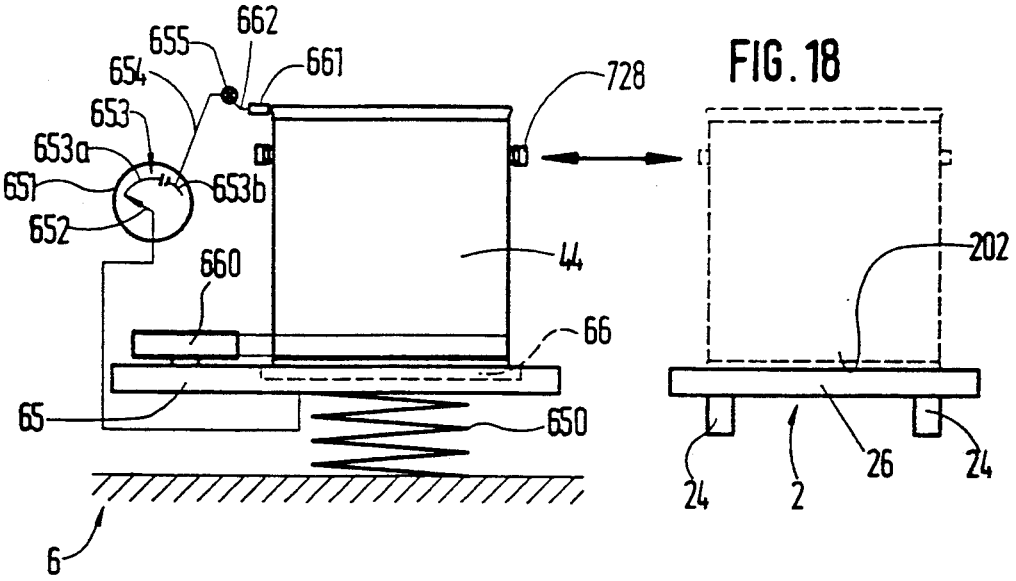
FIG. 18

DEVICE FOR THE TRANSPORTION OF CANS BETWEEN MACHINES OR DEVICES TREATING OR PROCESSING FIBER SLIVERS

BACKGROUND OF THE INVENTION

The instant invention relates to a process for the transportation of cans between machines or devices treating or processing fiber slivers. At least one of these machines or devices is assigned a can receiving point and a can delivery point, with a can conveying device capable of travelling on a set route between the machines or devices treating or processing fiber slivers, as well as to a device to carry out such process.

In automatic can transportation the problem consists in conveying the cans from a machine or device treating or processing fiber slivers to another such machine or device. A method is known (from a draw frame) by which can conveying devices are positioned at the draw frame on which the cans are pushed out of the filling position (See German Patent Publication No. DE-PS 1,265,014). The can conveying devices (carriages) are then pushed on, each time by one can fraction so that it is able to push out the next cans. This has the disadvantage that the can conveying device must generally alter its position, when it delivers empty cans, before being able to accept the full cans. This is not only clumsy, with respect to the required drive and guidance devices for the carriages, but also requires too much space. Another problem occurring in automatic the transportation between two or more machines or devices treating or processing fiber slivers consists in the fact that these machines or devices can be different in nature, so that the can requirement or the output of cans is also different.

SUMMARY OF THE INVENTION

It is the object of the instant invention to provide a process and an automatic can conveying system which improves the operation at and/or between the machines or devices treating or processing the fiber slivers and, thus leads to savings in time and/or space.

This object is attained through the instant invention in that the can conveying device is loaded and unloaded in one position at a machine or device treating or processing fiber slivers. Thus time is saved, as the cans are not first taken from the can conveying device in the work phase in one work position, while new cans are loaded on the can conveying device later, once the can conveying device has assumed a new work position, but the can conveying device assumes a position in which loading and unloading can be effected simultaneously. Such a process leads to a more compact design of the machines or devices in the area of their can arrival and their can delivery point, since these are to be placed in such a relative arrangement that a simultaneous movement makes loading and unloading possible.

Such a machine or device is especially compact if the can conveying device is able to travel between the can receiving point and the can delivery point, since the can conveying device, according to the invention, can then be unloaded on one side and be loaded on the other side.

So that different methods for loading and unloading of the can conveying device need not be applied for the different machines or devices treating or processing fiber slivers, to be connected through the can conveying device, only one full or empty can, at a time, is advantageously loaded and at the same time one empty or full can is unloaded. In this way, one and the same loading or unloading device can be provided at each of the different machines or devices treating or processing fiber slivers for loading and unloading.

In long spinning or twisting machines it is especially difficult to replace sliver cans. Contrary to what occurs in other machines (e.g. draw frames) the cans do not travel through the machine or device and are not always conveyed to the same location of the machine or device, nor are they always taken from another, also unchanging location of the machine or device. In order to allow for optimal operation of machines and/or devices connected to each other via the can transportation system, according to the instant invention, at least two can holding locations are provided on the can conveying device, one of these being empty at the beginning of a can replacement, so that the can to be exchanged is loaded unto this empty can holding location from a can holding platform serving, at the same time, as can delivery and can receiving point at one of the machines or devices. The can conveying device then moves, with a lift the can to be exchanged standing on the can holding location to the now full can holding platform of the machine or device and unloads the can to be exchanged so that the can holding location is again free on the can conveying device. In order to obtain easy movement during loading or unloading, it is advantageous for the loading and/or unloading process to be carried out substantially without lifting or lowering of the can. Thereby, the loading and/or unloading process is carried out substantially with only one translational motion of the can. It is especially advantageous, when separate loading and unloading devices are unavoidable at the individual machines or devices treating or processing fiber slivers, for the loading and/or unloading process to be carried out on the can conveying device.

In order to avoid having to coordinate the operations of the machines or devices treating or processing fiber slivers connected to each other through the can conveying device, a further development of the process, according to the instant invention, provides for a can, which must be brought from a first machine or device treating or processing fiber slivers to another machine or device treating or processing fiber slivers, to be temporarily stored in a can storage facility when the can is not needed at that moment at the other machine or device treating or processing fiber slivers, and to be called out of this temporary can storage facility only when this can is needed at the other machine or device treating or processing fiber slivers. Due to this intermediate storage of cans, the differences in the operating speed or the differences in work cycles at the different machines or devices can be compensated. In a further embodiment of the object of the instant invention a can is inspected between the two machines or devices treating or processing fiber slivers. This can be carried out in combination with an intermediate can storage, but also independently thereof. A can storage facility, combined with a can inspection station, offers the advantage that a relatively long time is available to subject the can to an inspection to eliminate damaged cans or to empty cans which are not completely empty, for any reason, so that a can may always contain one single, uninterrupted fiber sliver after having been filled. Such a process can be applied in connection with the simultaneous loading and unloading of the can conveying device as well as independently thereof. Neither does it depend on the manner in which the can replacement is carried out at long spinning or twisting machines.

The inspection can be carried out at different locations. It best not be carried out at machines or devices treating or processing fiber slivers themselves, since this would require providing a plurality of inspection stations. To avoid this, the instant invention provides for the can to be either inspected on the set route of the can conveying device or for the can to be taken out of the set route for inspection, e.g. in a storage facility in which this inspection can then be carried out. In order to avoid impairing downstream operations through faulty or not completely empty cans, it is advantageous to prevent the faulty cans from being taken to one of the machines or devices treating or processing fiber slivers.

To prevent a full can from containing several sliver fragments, the can to be filled is inspected with respect to its fullness. This may be achieved by different means, e.g. by scanning the interior of the can with a sensor to determine the filled state. It is, however, also possible to weigh the can in order to ascertain its filled state.

If it is found that the cans to be filled still contain fiber sliver remnants, such a can is emptied in a further development of the process according to the invention before it is conveyed on to be filled.

Since deficiencies may occur during further treatment or processing of fiber slivers if the cans are damaged, it is advantageous to inspect the cans in order to ascertain whether their physical condition is faultless.

To carry out the process, the instant invention provides for the can receiving point and the can delivery point of a machine or device treating or processing fiber slivers to be placed close together and along the route of the can conveying device and for a can shifting device to be provided, by means of which one can is brought from the can conveying device into the can receiving point and, simultaneously, another can is brought from the can delivery point to the can conveying device. This makes it possible to obtain a compact construction which, furthermore, saves time in operation.

In order to effect loading and unloading of the can conveying device easily, in one single movement, the invention provides for the can receiving point and for the can delivery point to be arranged symmetrically with respect to the can conveying device in the loading or unloading positions.

In order to avoid having to provide for the synchronous operation of the machines or devices treating or processing fiber slivers connected to each other through the can conveying device, a can storage facility is provided in a further advantageous manner between the two machines or devices treating or processing fiber slivers. The can storage facility temporarily accepts cans, which cannot be conveyed at the moment to the next machine or device treating or processing fiber slivers, until the can placed, at disposal, in this can storage facility is needed. Such a design of the invention is especially advantageous in combination with a can shifting device for the simultaneous loading and unloading, but also optimizes the can transportation between machines or devices treating or processing fiber slivers also independently of a can shifting device, designed in this manner.

Depending on the machine or device treating or processing fiber slivers, it may be advantageous to install the can receiving point and/or the can delivery point of the machine or device with intercalation of a can storage facility directly at this machine for device treating or processing fiber slivers. This is very advantageous with a draw frame, for instance.

It has proven to be advantageous for the can storage facility to be subdivided into two can storage divisions, of which one can storage division is used to store empty cans and the other can storage division is used to store full cans.

The can storage division for the storage of empty cans is preferably provided with a can receiving point and the full can storage division with a can delivery point, with the can receiving point and the can delivery point being placed close to each other and along the route of the can conveying device. A can replacement device is also provided, by means of which one can is brought from the can conveying device into the can receiving point while another can is brought, simultaneously, from the can delivery point onto the can conveying device. As mentioned earlier, such an arrangement makes it possible to obtain a space-saving device which, at the same time, allows for time-saving operations.

It is also an advantage, according to the instant invention, for the route of the can conveying device to take its course at least along one of the machines or devices treating or processing fiber slivers and/or along the can storage facility between the can receiving point and the can delivery point. An especially compact method of operation, affording short routes to be travelled for the loading and unloading of the can conveying device, are achieved if the two storage divisions and the route of the can conveying device are parallel to each other in the area of the can storage division.

In order to achieve simple loading and unloading movements, the can storage facility has, preferably, an horizontal can holding platform as well as a driven conveying device extending from one end of the can holding platform to its other end. This conveying device may, in principle, be designed in different manners, e.g. in form of driven rollers; however, it is preferably constituted by a conveyor belt or a conveyor chain.

A subdivision of the can storage facility into two can storage divisions is advantageous especially when a filling head is located between the can storage facility with the can receiving point and the can storage facility with the can delivery point. Whereby it is possible to present an empty can, coming from the can storage facility with the can receiving point, to said filling head from which it can be transferred into the can storage facility with the can delivery point once it has been filled. Such filling heads are placed, as a rule, independently of other filling heads, so that they are particularly accessible, and that can storage facilities can be assigned to them in a particularly simple manner.

In order to present an empty can to the filling head and in order to be able to eject the filled can later, a further embodiment of the invention provides for the filling head to be provided with a can shifting device which carries out the presentation of an empty can and the removal of a filled can.

In order to provide especially simple control of the cans in the proximity of the filling head, the can receiving point and/or the can delivery point is located at the end of the applicable can storage facility away from the filling head in a preferred embodiment of the device according to the invention. In this way, the empty cans must be moved, at the can receiving point, in the direction of the filling head and the full cans must be moved from the filling head in the direction of the can delivery point. It is thus not necessary to provide movements in several conveying direction in the can storage facilities.

In a preferred embodiment of the invention the can shifting device, assigned to the filing head, is provided with a conveyor belt or conveyor chain which extends to the end of the can storage facility. In order to achieve as unobtrusive a transition as possible from the can storage facility to the conveyor belt or conveyor chain assigned to this filling head, at least one filler element to fill the interval is provided between the can storage facility and the conveyor belt or conveyor chain.

A conveyor belt or a conveyor chain does not function with as much precision as a mechanical grasper unless special measures are taken. It is, therefore, advantageous for the can shifting device assigned to the filling head to also comprise a grasper, alone or in addition to a conveyor belt or a conveyor chain, which brings the can into the exact relative position in relation to the filling head.

The can storage facility is arranged independently of a machine or device treating or processing fiber slivers. This is advantageous especially when the cans stored in this can storage facility are to be presented to a spinning or twisting machine with a great number of work stations where no room is available for such an intermediate storage, as otherwise the accessibility of the machine would be affected.

The route of the can conveying device constitutes a conveying system consisting of three can circuits connected to each other, whereby a first can circuit comprises two machines or devices treating or processing fiber slivers and the two other can circuits each comprises one of these machines or devices treating or processing fiber slivers and the can storage facility. Here several rail systems may be connected to each other or it may at least be possible to connect them temporarily to each other.

In an embodiment of the invention, more than one machine or device treating or processing fiber slivers comprising a filling head and more than one other machine or device treating or processing fiber slivers is provided along the route of the can conveying device. Such a design of the invention is, basically advantageous, whether or not the can conveying device is loaded and unloaded, simultaneously, and whether or not a can storage facility is provided between the machines or devices treating or processing fiber slivers.

Where more than one machine or device with the filling head and more than one machine or device treating or processing fiber slivers are present in one machine combination, the different can circuits, in advantageous embodiments of the invention, may be laid out in different manners as required. The first can circuit comprises any one of the machines or devices with one filling head and any one of the machines or devices treating or processing fiber slivers, and each of the other two can circuits comprises any one of the machines or devices with a filling head or any one of the other machines or devices treating or processing fiber slivers, without a filling head. Such a device allows for very flexible operation.

The filling head is part of a machine or device treating or processing fiber slivers to which the fiber sliver can be brought in round cans, regardless of whether the fiber sliver is again filled into round or flat cans. The filling head is here, preferably, part of a draw frame.

In order to prevent the further processing of fiber slivers to lead to difficulties, another embodiment of the invention provides for a can inspection station to be installed along the route of the can conveying device to inspect the contents and/or state of the cans. It is possible to ascertain by means of such a can inspection station whether the can along the route are in perfect condition and/or whether the cans are empty. In this way, delays or malfunctions are avoided in the can transportation, especially during the replacement of cans as well as during the filling of cans and removal of the fiber sliver from the cans. According to the invention, this inspection is carried out not at one of the machines or devices treating or processing fiber slivers but along the route of the can conveying device, so that the operation of the machines or devices treating or processing fiber slivers is not impaired in any way. For this reason, the can inspection station is installed either on the can conveying device or along the route of the can conveying device.

The can inspection station may be designed in different ways and is equipped with a can weighing device in one embodiment. In an advantageous embodiment of such a can weighing device, it is possible to provide the can with a bottom capable of being moved perpendicular to its circumferential wall, and to provide the can inspection station with a lifting device which is part of the can weighing device and which can be assigned to the bottom.

In an alternative embodiment of the invention, the can inspection station is provided with inspecting elements which scan the contour of a can, with additional means being provided to produce a relative movement between the can and the inspection element so that the inspection element can be brought to any desired location of the contour of the can. Such an inspection element is unsuitable to ascertain the physical state of the can as well as the can's fullness. To inspect the contents of the can, the can inspection station is provided with a sensor scanning the bottom of the can.

In order to prevent cans which have been rejected from remaining in the can circuit it is advantageous for the can inspection station to be connected to a can storage to which the cans rejected at the can inspection station may be brought. Due to the fact that it is possible for these faulty cans to be taken out of the can circuit in this manner, it is now possible to either repair these cans at leisure or to eliminate them permanently if it is found that the cans are no longer in perfect condition.

If cans are rejected because they are not completely empty it is advantageous for them to be emptied automatically. For this purpose either the can inspection station and/or the can storage is designed with a can emptying device. Such a can emptying device can be designed in different ways, in principle, e.g. in the form of a suction device which is brought into the interior of such a can to be emptied. Preferably, however, the can emptying device is equipped with a can tilting device.

In order to ensure that the fiber material taken from the rejected cans does not remain in the can storage or at the can inspection station, a further embodiment of the invention provides for the can emptying device to be assigned a transportation device by means of which the fiber material taken from the can may be conveyed to a fiber material collection station. As mentioned earlier, the can inspection station may, in principle, be located at any desired location between the machines or devices treating or processing fiber slivers connected to each other. It is, however, especially advantageous if the can inspection station is located in a can circuit with a can storage facility, as the normal transportation of the cans between the different machines or devices treating or processing fiber slivers is thus completely unimpaired.

To avoid irregular feeding of the can storage facilities and to thus ensure that a sufficient number of cans is available when needed, it is advantageous for the can storage facility to be assigned a signalling device which is triggered when the can storage facility in question becomes too full or too empty.

In order to be able to carry out can transportation and/or can replacement at the desired time, an embodiment of the invention provides for the machines or devices treating or processing fiber slivers to be equipped with a "can required" notifier. Such a "can required" notifier can be installed on a machine or device equipped with a filling head as well as on some other machines or devices treating or processing fiber slivers without filling head.

In a simple and advantageous device the "can required" notifier is equipped with a sensor for scanning the interior of a can. Alternatively, it is also possible to equip the "can required" notifier with a measuring device for measuring sliver consumption on the machine or device treating or processing fiber slivers. Furthermore, an additional sensor to scan the fiber sliver which enters the machine or device treating or processing fiber slivers is provided.

In a simple embodiment of the invention a window, which can be presented to the sensor, is provided in the can. Such a window also enables the operator to easily supervise the fullness of the can, and this may be of great advantage for inspection purposes. The window extends in the longitudinal sense of the can while the sensor can be adjusted to different vertical positions in relation to the can, so that the lead time between requesting a can and its delivery can be extended. In order to prevent a fiber tuft from catching at the window the latter is advantageously closed with a transparent insert.

The "can required" notifier is connected to the can conveying device for control purposes. The "can required" notifier is thus able to trigger automatically the arrival of a new can and the replacement of the can at the machine or device treating or processing fiber slivers.

If several can circuits are provided, the "can required" notifier is capable of being connected for control to such a can conveying device located either, within the can circuit between the machine or device treating or processing fiber slivers equipped with the "can required" notifier and another such machine or device, or between the machine or device equipped with the "can required" notifier and the can conveying device. This ensures that a new can is rapidly brought into its operating position. Unnecessary time loss is thus avoided.

In order to avoid complicated lifting movements at the two machines or devices treating or processing fiber slivers connected to each other through the can conveying device, the can conveying device is provided with a can holding platform which is located, at the most, 100 mm higher than the can holding platform of the can receiving point and/or of the can deliver point. Such an arrangement of the can holding platforms is, not only advantageously and used in combination with a can conveying device, being loaded and unloaded at the same time, and/or in combination with a can storage facility or in combination with more than two machines or devices treating or processing fiber slivers approachable by a can conveying device as well as in combination with a can inspection station, but also independently thereof.

The smaller the difference in height between the can holding platform on the can conveying device and the can holding platform of the can receiving point and/or of the can delivery point, the easier it is to effect the can replacement movements. For this reason it is an advantage for the can holding platform of the can conveying device to be located, at the most, 40 mm higher than the can holding platform of the can receiving point and/or of the can delivery point when a difference in height cannot be avoided. Preferably, however, the can holding platforms of the can receiving point and/or of the can delivery point as well as of the can conveying device are essentially at the same horizontal level. In that case a horizontal movement for the replacement of cans at the machines or devices treating or processing fiber slivers suffices.

Especially when can replacement is effected through shifting, wear-proof sliding edges are provided on the can holding platforms and/or on the can bottom, the sliding edges being advantageously made of polyethylene.

The can conveying device may be of varying designs, e.g. in the form of a carriage suspended from a rail. It is, however, especially advantageous to design the can conveying device in form of a ground vehicle. In that case, it is especially advantageous for the can holding platform on the machine or device treating or processing fiber slivers to be in form of a pedestal adapted in height to the can holding platform of the can conveying device.

It is, in principle, possible to place the can holding platforms at different heights at the machines or devices treating or processing fiber slivers connected to each other through the can conveying device. However, this means that different movements for loading or unloading of the can conveying device must be carried on the different machines or devices treating or processing fiber slivers. To be able to carry out identical loading and unloading movements no matter where they take place, it is especially advantageous for the can holding platforms of the can conveying device and of all the can holding platforms to which the can conveying device can be brought to be at the same level.

To be able to load and unload the can conveying device simultaneously it is possible to provide two can shifting devices working synchronously, one of which is located at the can delivery point, for example, and the other at the can receiving point. It is, however, advantageous to provide one single can shifting device which is subdivided into a shifting device element to unload a can from the can conveying device and into a shifting device element to load a can on the can conveying device. Such a design of the can shifting device is used to advantage when the loading and the unloading of the can conveying device is not simultaneous, and, also, whether or not a can storage facility is provided. Such a design of the can shifting device is also independent of the number of machines or devices treating or processing fiber slivers approachable by the can conveying device and of the presence of an inspection station. Neither does the relative height arrangement of the different can holding platforms impair or affect the configuration of the can shifting device.

By subdividing the can conveying device into two shifting device elements, it is, on the one hand, possible to design these shifting device elements to be in one and the same plane, transversely to the route of the can conveying device, so that can replacement takes place in one and the same plane.

The can conveying device is, preferably, provided with at least two can holding platforms to receive one can each, placed one behind the other in the direction of travel. This also makes it possible to place the two shifting device elements in two planes which are transverse to the route of the can conveying device and which are separated from each other by a distance equal to the width of a can holding platform. This makes it possible on a spinning and twisting machine, for example, to bring a can into its operating position at a work station and to take a can from the adjoining spinning station to load it on the can conveying device.

When two shifting device elements are provided these can also be designed so that they are controlled independently of each other.

In spinning or twisting machines or also in other machines or devices treating or processing fiber slivers, can holding locations are provided which are, at the same time, a can receiving point and a can delivery point. In one such instance, provisions are made, according to the invention, for the distance between the can holding locations on the can conveying distance to be essentially equal to the distance between the can holding locations on the different machines or devices treating or processing fiber slivers.

The can shifting device may be of different designs. In an advantageous embodiment of the invention the can shifting device is provided with a grasping means to grasp a can near its lower end. In this case it is advantageous, in order to ensure reliable operation, for the can to be equipped at its lower end with a projection to interact with the grasping device. It is advantageous for the can to be designed in form of a flat can and for the projection to be located at the end, i.e. at the narrow side of the flat can, i.e. for such a projection to be provided at each of the two narrow can sides. In a preferred embodiment of the invention the projection is made in form of a supporting hoop.

In a preferred embodiment of the invention the can shifting device is provided with a grasping device which is located on a sled capable of being shifted transversely to the longitudinal extension of the can conveying device. The sled being, in turn, installed on a supporting sled capable of moving transversely to the longitudinal sense of the can conveying device.

If it is unavoidable for the can holding locations on the can conveying device and on the machines or devices treating or processing fiber slivers to be placed at different heights, the can shifting device is equipped, according to the invention, with a grasping device to grasp the can and with a lifting device to lift the grasped can. For this purpose the grasping device is preferably mounted on a lifting column capable of vertical movement.

In principle, it does not matter where the can shifting device is located, but it is especially advantageous and space-saving for it to be located on the can conveying device, since one single can shifting element suffices, in that manner, for all of the machines or devices approachable by the can conveying device.

The can conveying device is, preferably, provided with two can holding locations, each of which is assigned a separate can shifting device. In order to be able to use the can conveying device without rotation over 180° for both longitudinal sides of a spinning or twisting machine, the can shifting device for the exchange of cans can be moved, at will, in one or the other direction perpendicular to the can conveying device.

For the sake of optimal control of the can conveying device and, thereby, for the sake of optimal can supply and removal, it is especially advantageous for the machines or devices treating or processing fiber slivers and for the can conveying device to be connected for the control of the can conveying device to common controls. These common controls, thus determine the sequence of the different tasks and ensure, in this manner, that no stoppages occur but that cans are always available for continued operation at the different machines and devices.

The control device may go beyond a normal computer and be provided with contact-less transmitters along the route of the can conveying device, the transmitters interacting with an appropriate, also contact-less receiver on the can conveying device. The transmitter and the receiver are, advantageously, made in form of infrared devices.

In spinning or twisting machines, a plurality of cans must be arranged next to each other. Such machines have a plurality of identical adjoining work stations which must be supplied from these cans, so that it is necessary to assign a can to each work station. This is was possible in the past only by arranging the cans in two rows. To avoid this, an additional embodiment of the invention provides for the cans to be made in form of flat cans and for the can conveying device to be capable of travelling at a perpendicular to the longitudinal sense of the flat cans.

It has proven to be especially advantageous for the can storage facility to extend transversely to the longitudinal sense of the flat cans when flat cans are to be conveyed. On the other hand, it is advantageous for the can replacement device to be moved parallel to the longitudinal sense of the flat cans on the can conveying device or in the can storage facility.

The flat cans are designed, according to the invention, in such manner that their width is essentially equal to the width of a work station of a spinning or twisting machine and their dimensions are selected so that the capacity of the flat can is equal to the capacity of round can used normally in spinning or twisting machines. In that case, it is possible to arrange the cans at the machine in one row. It is advantageous to size the flat cans so that the capacity of the flat can is essentially the same as that of a round can with a diameter of 450 to 500 mm. It has been found that for this purpose it is sufficient if the length of the flat can is substantially four times its width.

If a flat can is used in combination with a sensor which scans the contents of the can through a window, the flat can is advantageously equipped with a window on each of its narrow sides so that it does not matter which narrow side is presented to the sensor.

For orderly loading and loading it has shown to be advantageous for the can to be given an unattached bottom which can be lifted up by action from outside.

"Machines or devices treating or processing fiber slivers", in the sense of the instant invention, are understood to be those textile machines which treat or process fiber slivers. Among these are, for example, drawing frames and spinning machines such as ring, air, false-twist and open-end spinning machines, but other textile machines which are fed fiber slivers for processing, such as for example circular knitting machines which are fed fiber slivers for the production of pile fabrics and carpets can also be suitable. Operational elements may, therefore, be carding devices (in a card), a drawing frame (e.g. in a card or air spinning machine), a spindle (e.g. in a ring spinning machine), a spinning element (spinning rotor etc. in an open-end spinning machine), a needle cylinder (in a circular knitting machine) etc. The location at which these operational elements are to be found shall be designated hereinafter as the "work station". As a rule a textile machine with which the object of the invention can be used has more than one work station, i.e. more than only one "machine or device treating or processing fiber slivers", but the invention is not limited to this.

In the sense of the instant invention, a "fiber sliver" should be understood to be any fiber sliver constituted by fibers, whether or not the fiber sliver has a certain twist, as is the case with rovings.

The instant invention allows, in an optimal manner, to carry out the replacement of cans on machines or devices treating or processing fiber slivers and to convey these cans between such machines or devices. The optimization is achieved through different measures applied to these machines or devices themselves or between them. The process or device characteristics allow for substantial automation of the can transportation while the can replacement, at the spinning stations, is carried out faster and more reliably, as well as for compensation of the work cycles on the different machines or devices connected to each other via a conveying device, in that the cans, which are not needed at the moment and/or are to be checked, are put in intermediate storage between the machines or devices treating or processing fiber slivers until they have been checked and/or are needed at another machine or device. The degree of effectiveness of such a machine installation is thus increased.

BRIEF DESCRIPTION OF THE DRAWINGS

The invention is explained in greater detail below through embodiments and with the help of drawings in which:

FIG. 11 is a schematic side view of the can conveying device shown in FIG. 4;

FIGS. 12 and 13 are a schematic top view of a plurality of cans in a spinning and twisting machine and a can conveying device during filling and unloading of a can;

FIG. 17 is a schematic representation of a can conveying device;

FIGS. 18 and 19 are schematic side views, each of a can conveying device at a can inspection point;

DETAIL DESCRIPTION OF THE INVENTION

Figure 1:
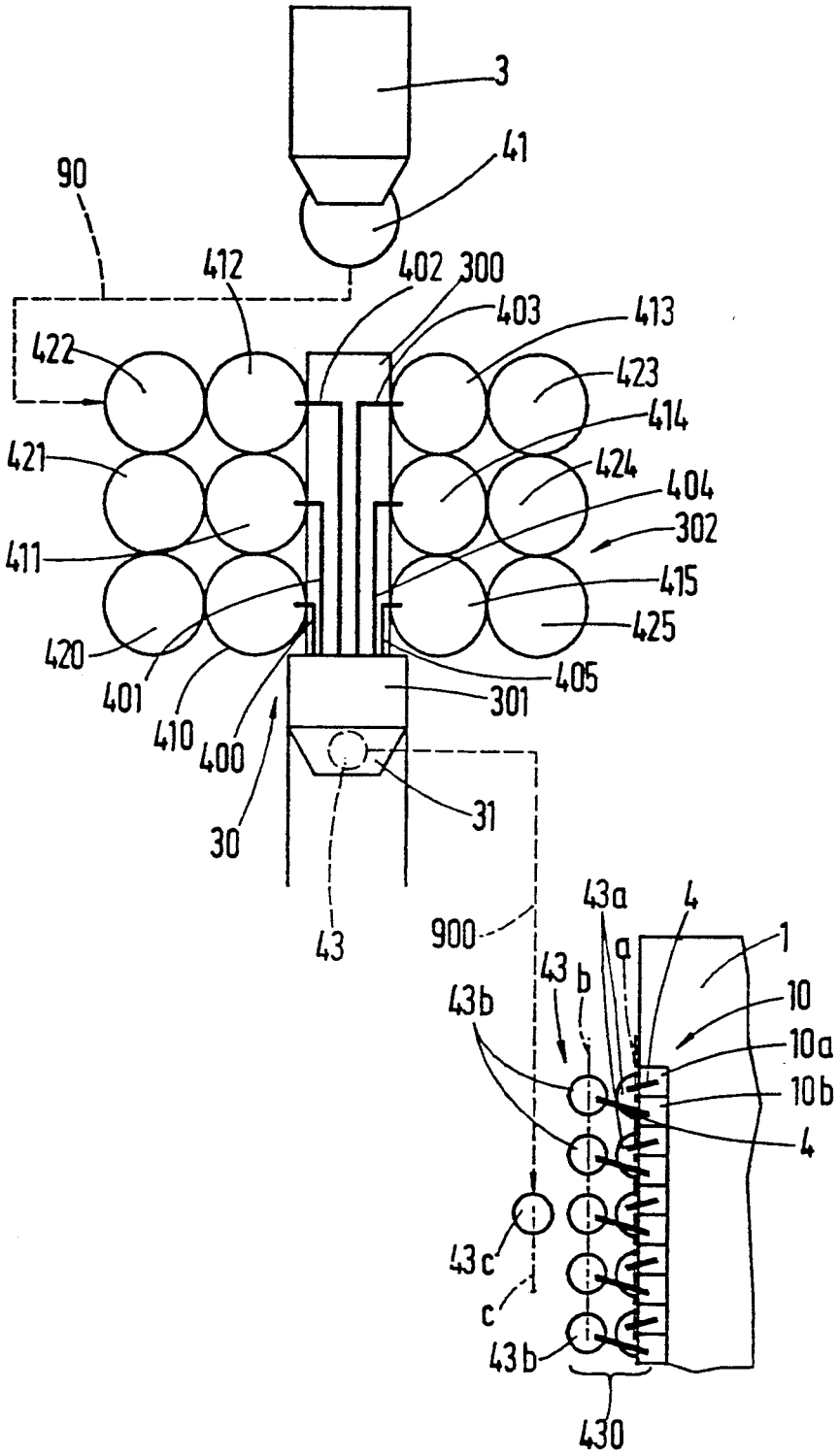
FIG. 1 is a schematic top-view of an installation with a card, a drawing frame, and an open-end spinning machine.

As mentioned earlier, the invention can be used in combination with different textile machines or devices which treat or process fiber slivers. In the following description an actual embodiment, taken as an example, is a conventional open-end spinning machine 1 consisting of card 3 and of a drawing frame 30 which is to be described with reference to FIG. 1.

The supply device of card 3 is not shown for the sake of clarity. The card 3 supplies a can 4 be means of a filling head which is not shown here, the can being conveyed to the drawing frame 30, as are the other cans (see route 90). In the embodiment shown, six fiber slivers 400 to 405 taken from cans 410 to 415 are fed to a drawing frame head 301. The thickness of the delivered fiber sliver in can 41 corresponds to the thickness of the individual fiber slivers 400 to 405 being fed. On either side of the drawing frame 30, reserve cans 420 to 425 are standing in a second row. The fiber slivers are conveyed above a sliver guiding table 300. For further details, see U.S. Pat. No. 4,838,018.

The newly formed fiber sliver (not shown) is fed into a can 43 by a filling head 31 which is part of the drawing frame 30. This can is moved out of the drawing frame head 301 once it has been filled. The can 43 is then brought to an open-end spinning machine 1 (see route 900).

Normally an open-end spinning machine is equipped with a plurality of adjoining work or spinning stations 10, arranged on one or both longitudinal machine sides of the open-end spinning machine 1. Each spinning station 10 is designed in the usual manner and is equipped with a spinning element, e.g. a spinning rotor to which a fiber sliver 4 is fed so that it may be spun into a yarn (not shown) in a known manner.

In the device shown in FIG. 1, the cans 43 are sized so that they extend across two adjoining spinning stations 10. For this reason every other spinning station 10*a* is assigned a can 43*a* of a first row of cans a, and each spinning station 10*b*, is assigned a can 43*b* of a second row of cans b.

If it appears that the fiber sliver 4 is about to run out in such a can group 430, consisting of a can 43*a* and a can 43*b*, an appropriate impulse is transmitted to the controls of the open-end spinning machine 1 which then cause a can 43*c* to be placed at disposal as soon as possible in a waiting position behind the two cans 43*a* and 43*b*. As soon as the can 43*a* or 43*b*, from which the fiber sliver 4 is currently taken for spinning has been emptied, the fiber sliver is taken out of can 43*c* and fed into the appropriate feeding device (not shown) of the spinning station 10*a* or 10*b* of such a pair of spinning stations which has been stopped by the depletion of the fiber sliver 4. The third can row C thus constitutes a can storage for cans 43.

Figure 2:
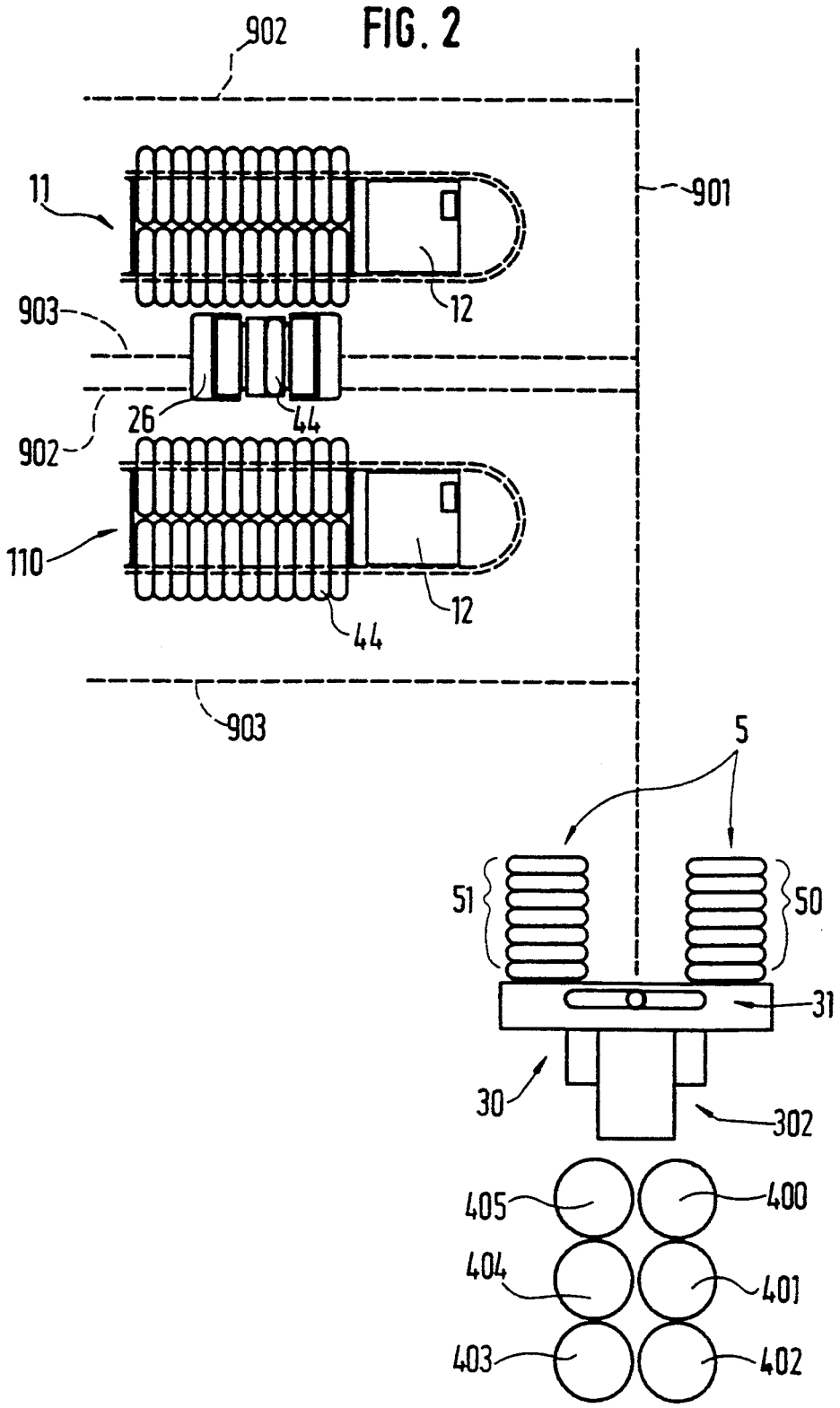
FIG. 2 is a schematic top view of an installation with two open-end spinning machines and a drawing frame and with a can conveying device to supply the rotor spinning machine with fiber slivers.

FIG. 2 shows another embodiment in which a can storage 5, consisting of two can stores 50, 51, is provided on the drawing frame 30. FIG. 2 schematically shows part of an installation with a drawing frame 30 and two spinning or twisting machines 11, 110, with only a portion of each shown in their longitudinal extension. The drawing frame 30 is equipped with a filling head 31 and with a can storage facility 50, 51, which shall be described in greater detail herein below. The intake 302 of the drawing frame 30 is laid out to interact with six round cans 400 to 405, for example (six times doubling). Each of the spinning or twisting machines 11, 110 is provided with an end head 12 which is located near a predetermined connecting route (route 901 shown by a broken line). The route 901 lets out into the output of drawing frame 30 so that the can conveying device 2 (see FIG. 3) can be positioned between the can storage facilities 50, 51. The route 90 can be constituted by a guiding line (optical sensory analysis) on the bottom of the vehicle or by a current conductor (inductive sensory analysis) beneath the bottom of the can conveying device 2 made in form of a ground vehicle. Thus, transmitters (not shown) operating in a contact-less manner may be provided along the route 901 of the can conveying device, e.g. infra-red devices interacting with the can conveying device 2 with a receiver (not shown) functioning also in a contact-less manner. In this embodiment, no can storage facility is assigned to the spinning or twisting machine 11 or 110.

Two bifurcations (routes 902, 903) connected to the route 901 extend along each of the machines 10, 110, whereby the two bifurcations take their course in proximity to the machines 50, 51 and parallel to each other and to the longitudinal axis of the machines.

When the spinning station 10, (see FIG. 1) with a can to be replaced, is located in the row of spinning stations closer to the spinning or twisting machine 11, the can conveying device 2 is given a travel command by a "can required" notifier 85, which shall be described in greater detail further below, to the spinning or twisting machine 11, ordering it to follow route 901 first, upon leaving the draw frame 30 and to branch off from this route only when it has reached the route 903 assigned to the spinning or twisting machine 110. In the case of the arrangement shown in FIG. 2, this is the third bifurcation. Thus, the can conveying device 2 is moved along spinning or twisting machine 11 in such manner as to be able to carry out the desired can replacement operation thanks to suitable positioning in the longitudinal sense of the machine, without being able to come any closer to the machine 11. The same applies with respect to the machine 110 when the can conveying device 2 receives a travel command to move along route 902 of this spinning or twisting machine 110.

As indicated, the route 901 can be extended in order to connect the drawing frame 30 to other machines or machine sides. These can also be machines of different types.

A machine arrangement, as shown in FIG. 2, can be controlled from the spinning or twisting machine 11, 110 in that each machine is connected via a signalling circuit (not shown) to the drawing frame 30 and transmits "delivery orders" to the drawing frame 30. The drawing frame 30 transmits such delivery orders on to the can conveying device 2, e.g. when the latter is in a can receiving position facing the drawing frame 30. The can conveying device 2, itself, can be provided with sufficient intelligence (computing capability) to convert the "delivery orders" into "travel commands" and to carry out these travel commands accordingly. This will be described further below in greater detail.

Figure 21:
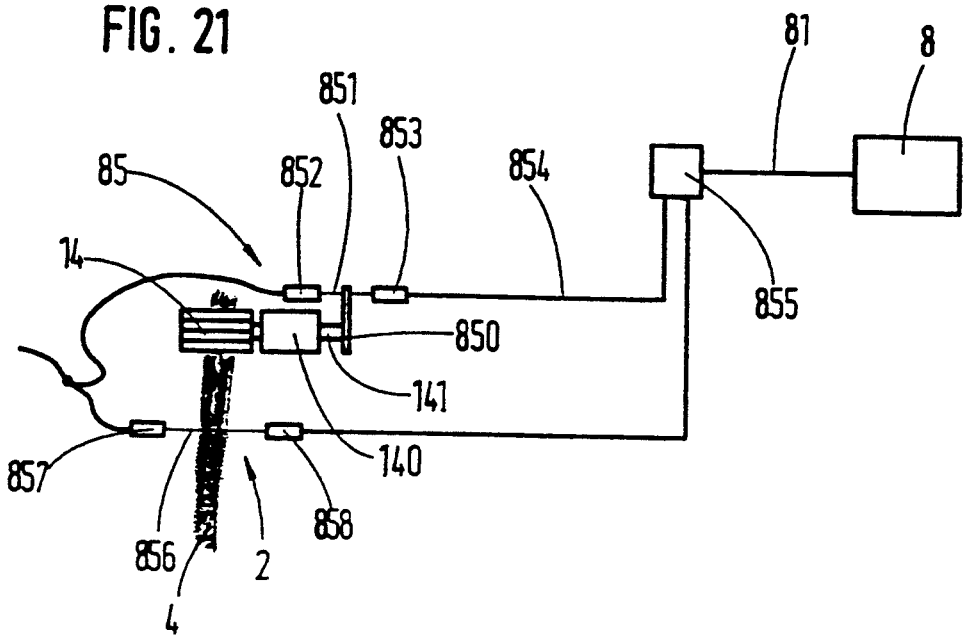
FIG. 21 is a schematic representation of a "can required" notifier which is connected to the controls shown in FIG. 14 for control.

A configuration of a "can required" notifier 85 to be provided at each spinning or twisting machine 11, 110 per spinning station 10 is now explained through FIG. 21. This Figure shows a delivery roller 14 or an open-end spinning machine 1 (see FIGS. 1 and 3) which can be driven through an individual drive 140, for instance, but this type of drive is of no importance since that a common drive may also be used for several adjoining spinning stations 10 (see FIGS. 1 and 3). A switching flag 850 is located on the shaft 141 of the delivery roller 14 which comes periodically within range of a light barrier 851 and of a photoelectric cell 853 when the delivery roller 141 rotates. The photoelectric cell 853 when the delivery roller 141 rotates. The photoelectric cell 853 is connected via a circuit 854 to a control device 855 of the open-end spinning machine 1 which is, in turn, connected via a data circuit 81 to control 8, which will be discussed further later.

The control device 855, together with the light barrier 85 constitutes a measuring device. This is because when the switching flag has emitted a given number of impulses corresponding to a given length and, thereby, to a given consumption of the fiber sliver 4, the control device 855 of the open-end spinning machine 1 actuates an impulse via the data circuit 81 in the control 8, said impulse being processed by the control 8 and being understood as a call for a full can 43 or 44. The control 8 may be installed on the can conveying device 2 itself (as described above) or may be stationary (as shall be explained in further detail later, in connection with FIGS. 14 and 15).

To avoid premature replacement of a sliver can by the new can, i.e. when the fiber sliver 4 has not yet been completely used up from the can at the spinning station 10 concerned, an additional light barrier 856 is provided before the delivery roller of the spinning station 10 concerned, between a light source 857 and a photoelectric cell 858. The photoelectric cell 858 is connected for control to the control device 855 on the machine which is connected, either directly to the can conveying device 2, or via the central control 8, brings about the actual can replacement at the spinning station when the fiber sliver 4 going into the spinning station 10 runs out.

Figure 14:
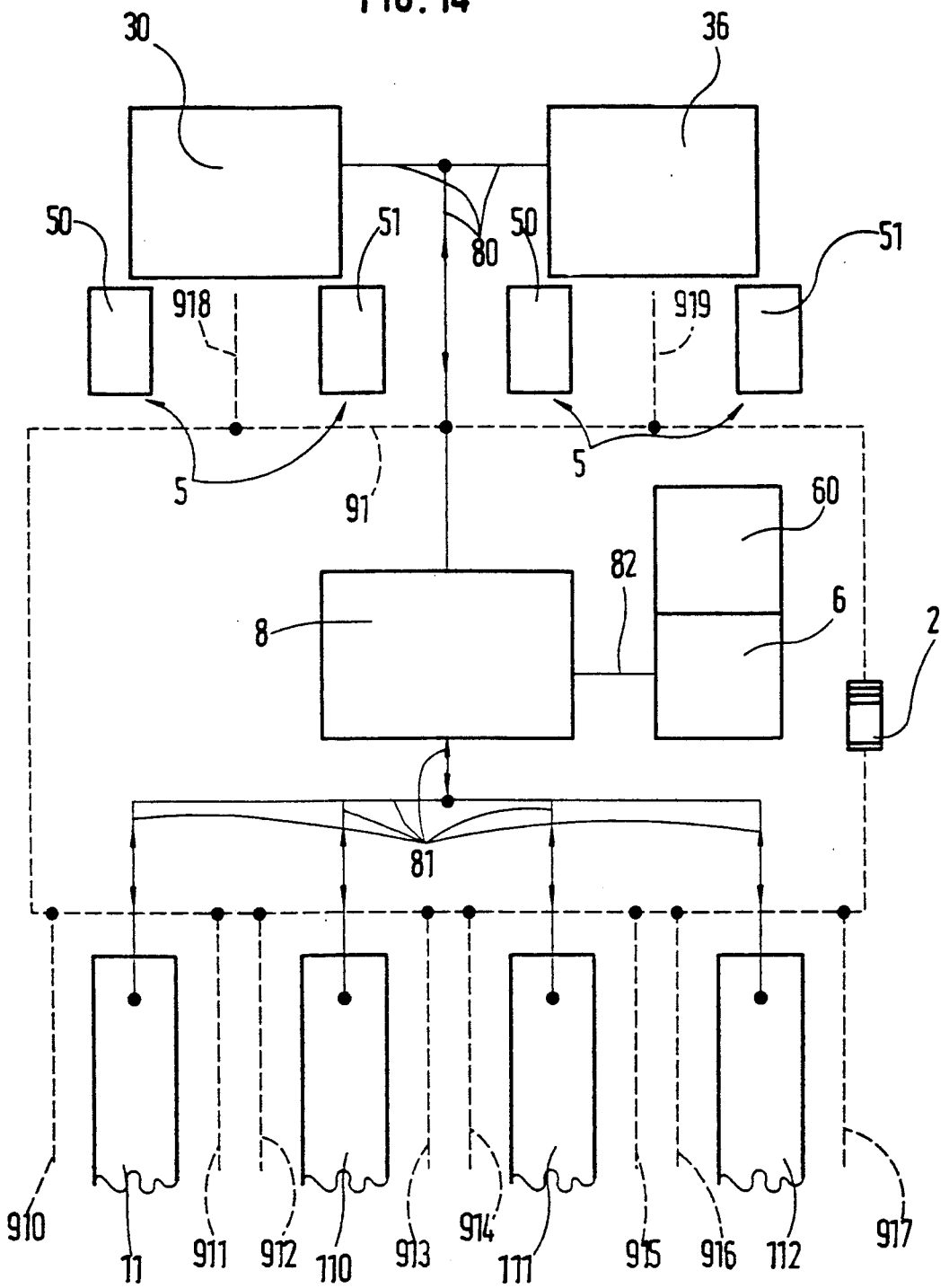
FIG. 14 is a schematic plan view of an overall installation, including controls.
Figure 15:
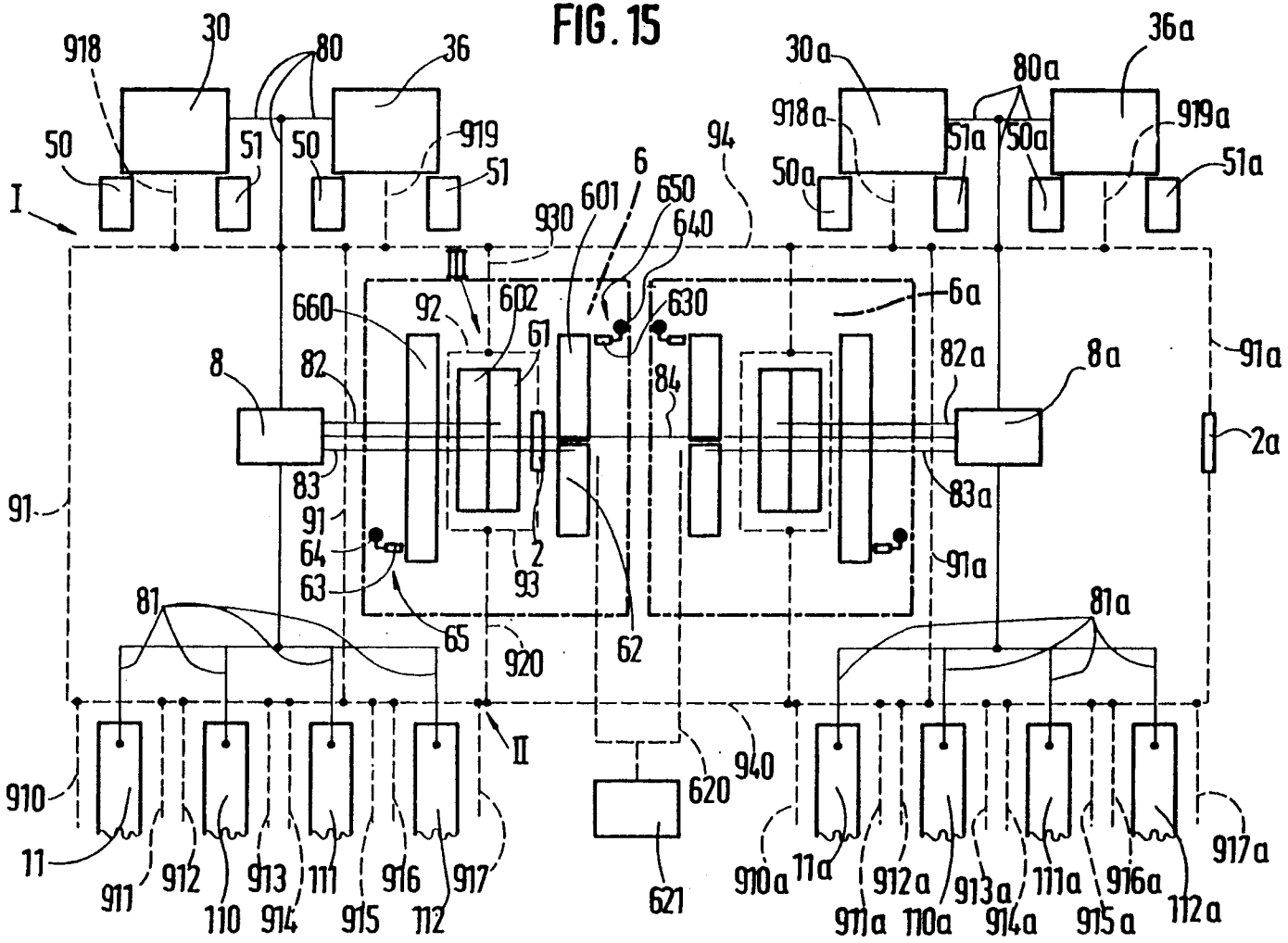
FIGS. 15 and 16 are schematic plan views of two machine installations capable of being coupled together via controls.

The can conveying device 2 to which the "can required" notifier 85 can be connected is located at either one of the machines installed in a plant or along the route between these machines, e.g. on a drawing frame 30 and a spinning or twisting machine 11 or 110 or between one of these machines and a can storage facility (e.g. can magazine 600 or 601) which can also be installed independently of these machines as shown in FIGS. 14 and 15.

Figure 22:
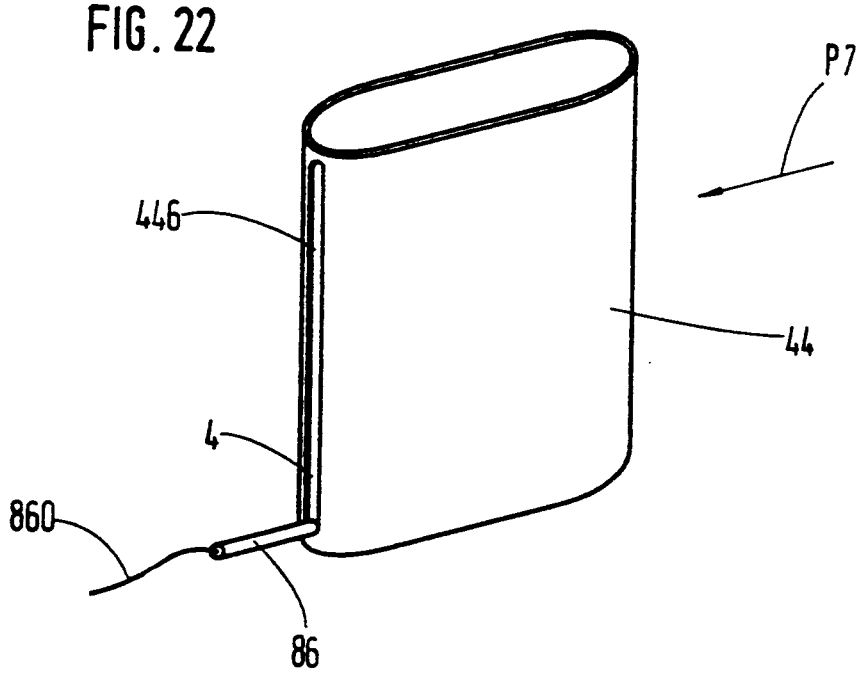
FIG. 22 is a perspective view of a flat can to which a "can required" notifier is assigned.

Another "can required" notifier 86 is shown in FIG. 22. The "can required" notifier 86 is made in form of a sensor which scans the contents of a can, e.g. of a flat can 44 and is connected via a circuit 860 to the control device 855 (see FIG. 21) at the machine.

For the "can required" notifier 86 to be able to verify the contents of a can, i.e. The interior of the can, the flat can 44 is provided with a window 446 at its narrow side, the window extending substantially over the entire height of the can, in the embodiment shown, and being sealed by a transparent insert to prevent impairment of fiber sliver deposit or removal. When the fiber sliver reaches the lower border of the window the "can required" notifier 86 is triggered and initiates the additional steps as described.

The "can required" notifier 86 is located on the side of the can away from the servicing side so that it need not be mounted so as to be capable of movement. This is indicated in FIG. 22 by an arrow $P_7$ which indicates the direction in which a can is presented to its work station.

In principle, a small window at the lower end of the flat can 44 would suffice. However, in order to provide different advance times from the time a flat can 44 is called up as a result of the "can required" notifier 86 being triggered to the time of can replacement, an oblong window 446 is necessary so that the desired advance time may be selected by changing the height adjustment of the "can required" notifier 86, in relation to the flat can 44, i.e. through vertical adjustment of the "can required" notifier 86 along window 446.

One window 446 suffices for round cans 43 (see FIG. 1). With flat cans 44 it is best for a small window or a window 446 extending practically over the entire can height to be provided at both narrow sides, at the lower can end (not shown), as the flat can 44 may be brought at will with either one or the other end into its work position and, thereby, within the scanning range of the "can required" notifier 86.

A "can required" notifiers may similarly be provided also at other machines or devices treating or processing fiber slivers.

In the embodiment shown in FIG. 2, the cans in which the fiber sliver 4 is deposited do not have a round profile but are of oblong configuration (flat can 44). their two long sides (side walls 440, 441, see FIG. 5) can thus serve as guides, as shall be described further below. Furthermore, the cans 44 may be sized so that only one single row of cans must be provided per row of work or spinning stations of the spinning or twisting machine 11, 110 (see can row a in FIG. 1)

Figure 5:
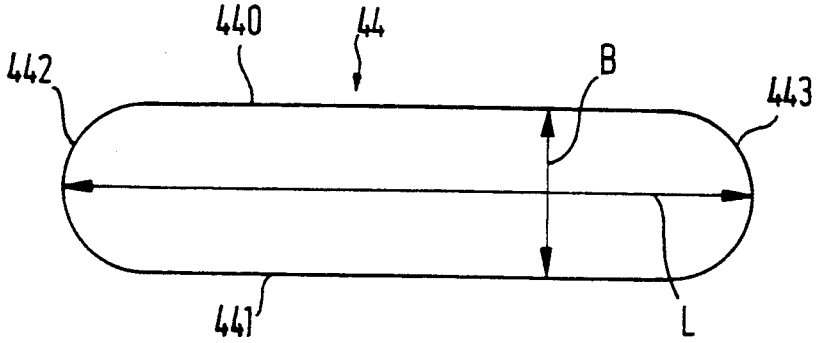
FIG. 5 is a top view of a flat can with dimensions in accordance with the invention.

The flat can 44 shown in FIG. 2 has two parallel side walls 440, 441 which define the can width B (See FIG. 5). The flat can 44 has also two end pieces 442, 443 which connect the side walls 440, 441 to each other and define the can length L. FIG. 5 shows rounded end pieces 442, 443 whereby the end pieces may also be perpendicular instead of round in relation to the side walls 440, 441 or may be polygonal in configuration. The can length L is considerably greater (e.g. three to four times greater) than the can width B which is essentially equal to the width of a work or spinning station 10. In this manner, i.e. because of the length of the flat can, being substantially four times its width, a capacity of the flat can (flat can 44) is obtained that is equal to the capacity of a round can normally used in a spinning or twisting machine.

The capacity of the flat can 44 should be as close as possible to the capacity of the round can (e.g. can 43 of FIG. 1) with a diameter of 450 to 500 mm. If it is assumed, for example, that the diameter of a conventional round can is approximately 457 mm, a flat can 44, according to FIG. 5, with a can width B of 230 mm and a can length L of 780 mm should have a slightly greater capacity than the round can. In other words, the length (can length L) of the flat can 44 need not be twice the diameter of the round can in order to have the same capacity. The height of the can (round or flat can) is determined by the construction of the spinning or twisting machine frame because the cans 43 or 44 must be placed underneath the spinning station.

Figure 6:
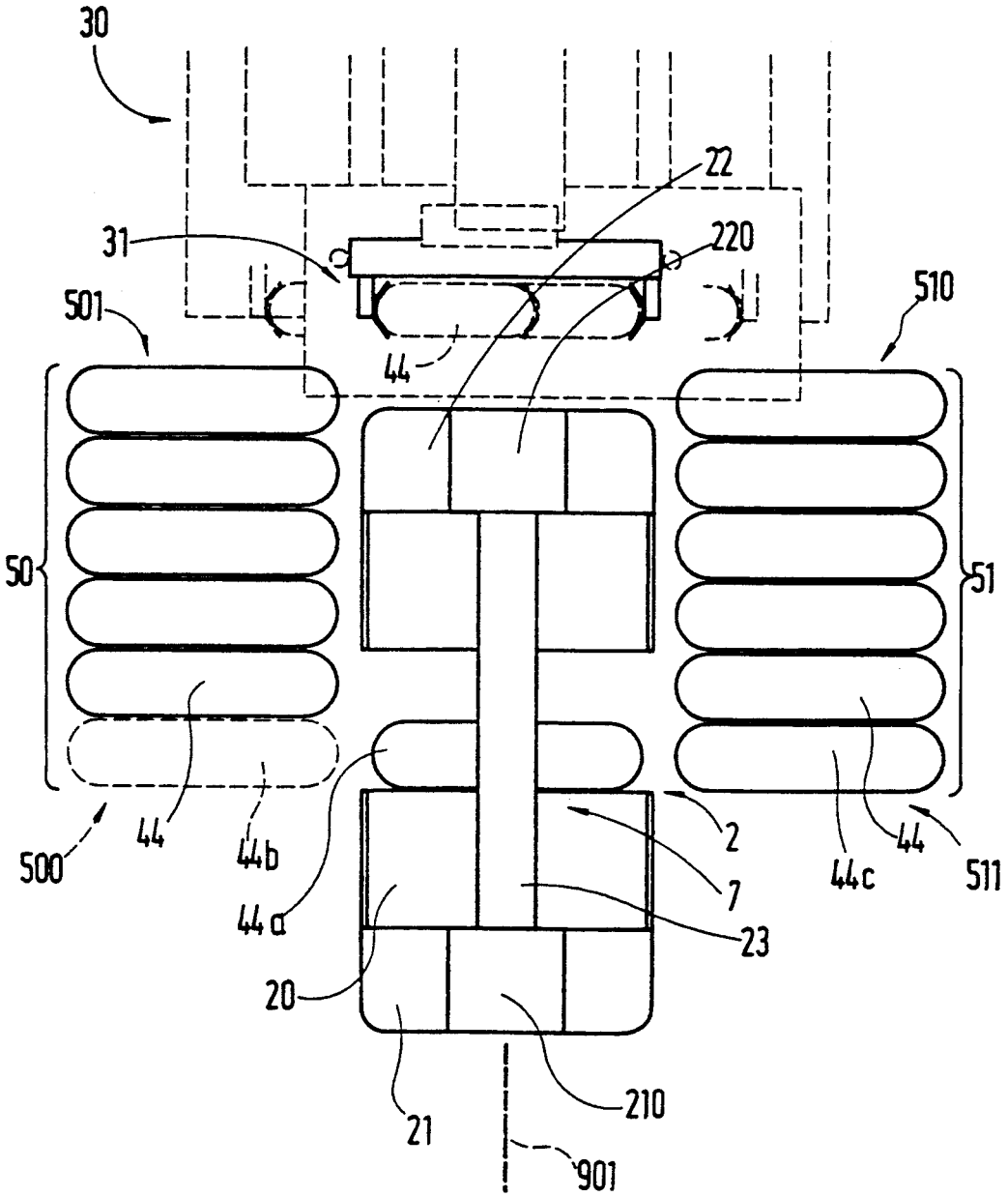
FIG. 6 is a schematic top view of the beginning and end of a drawing frame for interacting with a can conveying device.

FIG. 6 shows an enlarged representation of the drawing frame 30, shown in FIG. 2, with two can storage facilities 50, 51 and a can conveying device 2 located between these can storage facilities 50, 51. The drawing frame 30 is equipped with a filling head 31 with an alternating device 310 for the back-and-forth movement of a flat can 44 in its longitudinal direction during the filling process in order to distribute the fiber sliver 4 evenly in the flat can 44. The drawing frame 30, in turn, is provided with a first can storage facility 50 for empty cans and with a second can storage facility 51 for full cans. The flat cans 44 are arranged with their longitudinal axis parallel to each other in each of the can storage facilities 50, 51.

Since the can storage facilities 50, 51 are located before or after the filling head 31, they are outside the actual drawing frame 30 and, therefore, between two machines or devices treating or processing fiber slivers, i.e. between the drawing frame 30 and the spinning or twisting machine 11 or 110. Nevertheless, the two can storage facilities 50, 51 are located in immediate proximity of the drawing frame 30. The can receiving point 500 and the can delivery point 511 are thereby installed at the drawing frame 30 with intercalation of a can storage facility 50 or 51.

The can storage facilities 50 and 51, or one of them, may also be omitted if the cans move directly to or from the open-end spinning machine 1, it being, of course, necessary to provide for a "flying change-over" of the can conveying device 2, in that case. This means that in such an embodiment several can conveying devices 2 are required at the same time in one installation.

As will be shown and explained further below, a can storage facility can, however, also be installed independently of such a machine or device for processing fiber slivers 4.

Figure 7:
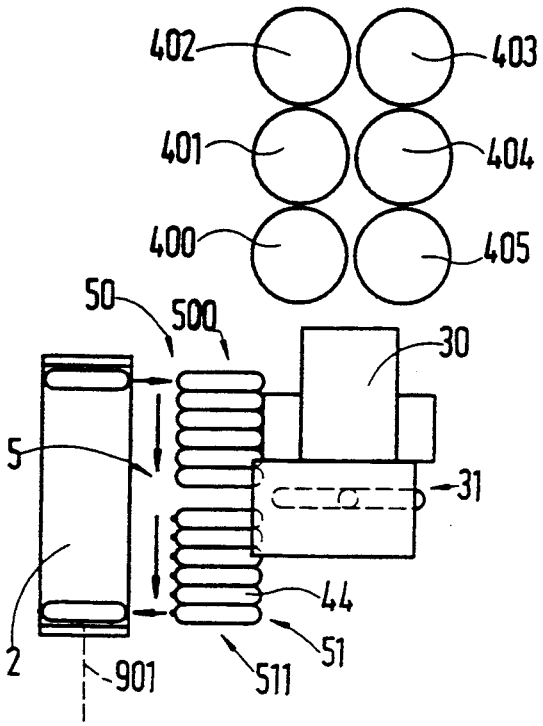
FIG. 7 is a schematic top view of a drawing frame with a first can storage facility for the empty cans and a second drawing frame for the full cans.
Figure 8:
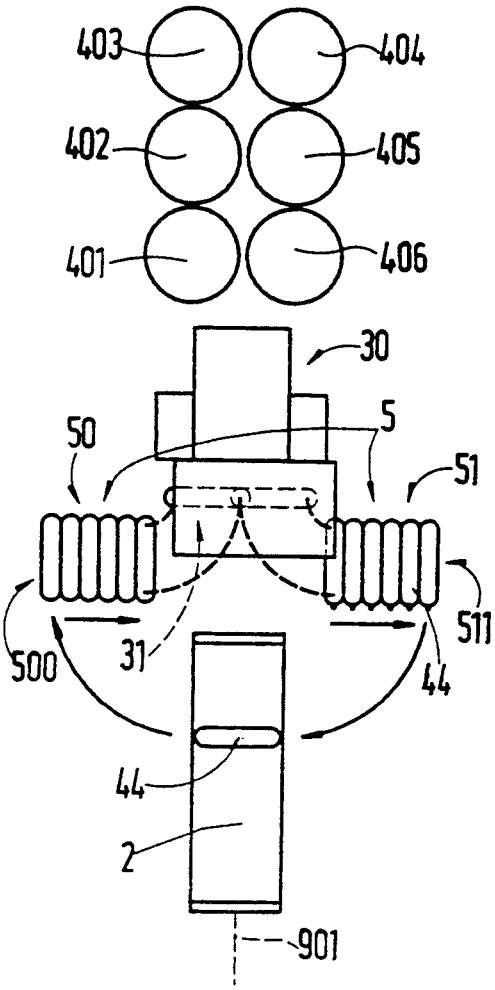
FIG. 8 is a schematic top view of an alternative arrangement of two can storage facilities.

The two can storage facilities 50, 51 together may be part of a can storage facility 5 (See FIGS. 7 and 8). The can storage facility 50 comprises a can receiving point 500 at its end away from the filling head 31 from which a flat can 44 can be transferred from the can conveying device 2 to the can storage facility 50. This can storage facility 50 also comprises a transfer point 501 from which a flat can 44 is delivered to the filling head 31 of the draw frame 30. The flat cans 44 are moved, by means not shown, perpendicularly to their longitudinal axis from the can receiving point 500 to the transfer point 501.

The can storage facility 51, correspondingly, comprises a can receiving point 510 on its end near the filling head 31 to receive a full can from the filling 31 of the drawing frame 30 and a can delivery point 511 for the transfer of a full can to the can conveying device 2. The flat cans 44 are moved in this case in a direction perpendicular to their longitudinal axis, between the receiving point 510 and the can delivery point 511.

The reception of a flat can 44 on the can conveying device 2, or the delivery of a flat can 44 from the can conveying device 2 is effected by a movement of the flat can 44, in question, in its longitudinal direction so that the required movements at the drawing frame 30 and at the spinning or twisting machine are identical. The flat cans 44 are thus arranged on the can conveying device 2 with their long sides (side walls 400, 441) next to each other and transversely to the direction of travel of the can conveying device 2.

FIG. 6 shows the can receiving point 500 of the can storage facility 50 unoccupied, and, for this reason, the flat can 44, shown here, is only represented by a broken line. By means of a synchronized shifting movement the can conveying device 2 is unloaded to the other s the shown position, at the drawing frame 30 and a full can is loaded from the other side at the same time, in that, empty flat can 44 is brought out of the can conveying device 2 from position 44*a* into the position 44*b*, shown by broken lines, i.e. into the can receiving point 500 while at the same time a flat can 44 previously filled by the filling head 31 of the drawing frame 30 is brought from position 44*c*, i.e. from the can delivery point 511 into position 44*a* on the can conveying device 2.

Depending on the design of the machine or of a can storage facility 50, 51, it is simultaneously possible to unload several cans and to load an equal number of cans on the can conveying device 2. For the sake of simple control and a simple device, only one single full can 44 is loaded and only one single empty can is, accordingly, unloaded simultaneously from the can conveying device 2, in the embodiment shown. In similar fashion, it is, of course, possible for an empty can to be loaded and for a full can to be unloaded at the same time with machines or devices treating or processing fiber slivers such as for instance a circular knitting machine for the production of plush fabrics etc.

As is shown in FIGS. 2 and 6, a can receiving point 500 of the can storage facility 50, as well as, the can delivery point 511 of the can storage facility 51 are installed in the immediate proximity of each other and along route 901 of the can conveying device 2. The can conveying device 2 is equipped with a can-receiving element 20 and with two end elements 21, 22. End elements 21, 22 supports posts 210, 220, these posts, in turn, supporting a beam 23 which serves as a guide rail for a can shifting device 7. The can shifting device 7 can be moved along the longitudinal axis of the beam 23 and can, thereby, be presented to individual flat cans 44 on the can conveying device 2. The can shifting device 7 is equipped with its own rail 710 which is perpendicular to the beam 23 and serves as a guide rail of a can pusher 71 (see FIG. 3). The can pusher 71 of the can conveying device 2 has a grasping device (not shown) which pushes the flat can 44 from the can conveying device 2 into the can receiving point 500 on the drawing frame 30 through a movement that is parallel to the longitudinal extension of the can and transversel to the direction of travel of the can conveying device 2, and, at the same time, pulls a second flat can 44 from the can delivery point 511 onto the can conveying device 2.

Each of the end elements 21, 22 of the can conveying device 2 is equipped with wheels 24 (see FIG. 11) which make it possible for the can conveying device 2, made in form of a floor vehicle in the shown embodiment, to move perpendicularly to the longitudinal side of the received flat can 44. The can conveying device 2 has a drive (not shown) and possibly controls which control a steering system (not shown) for the wheels 24.

When the can conveying device 2 leaves the drawing frame 30 it is loaded with ten full flat cans 44, with free space for the reception of one empty can.

For one single exchange of cans to be possible, between two and twelve can holding surfaces must be provided on the can conveying device 2.

If too many can holding surfaces are provided one behind the other on the can conveying device 2, the latter becomes too large and, especially in curves and at bifurcation, becomes very hard to maneuver.

If only one can holding surface is provided, this means that one can must be unloaded before another one may be received. As a result of this, the full unloaded can must first be brought to the final work station by the can conveying device 2 in machines where the can receiving point is, at the same time the can delivery point, as is the case in long spinning or twisting machine 11, 110, and this is difficult to achieve automatically. A practical number of can holding surfaces on the can conveying device 2 is, therefore, between two and twelve as mentioned.

FIG. 17 shows an embodiment of the can shifting device 7 with rail 710 on which a can pusher 75 is provided in such manner as to be capable of sliding along rail 710, can pusher 75 being, in turn, provided with two can grasping devices 726 and 727. The right can (flat can 44) was first on a pedestal 530 which is located at the same level "N" as another pedestal 53 as well as the upper edge of the can-receiving element 20 of the can conveying device 2. Furthermore, the pedestals 53 and 530, which are part of the can storage facility 50 or 51, are arranged as shown in FIG. 6 so that, by a simple translation movement, the flat can 44 on the right side on the pedestal 530 can be put on the can conveying device 2 by means of the grasping device 727, while at the same time the flat can 44, which was previously on the can conveying device 2, is placed by means of the grasping device 726 on the pedestal 53. Both shifting movements are thus effected, simultaneously, through one single movement of the can pusher 75, so that the loading and the unloading process takes place without lifting or lowering either of the cans (flat can 44).

Depending on the design of the can storage facility 50 or 51, it may be possible to carry out one movement alone as a translation movement or other horizontal movement, e.g. can unloading, while a combined translation/lifting movement may be required for loading. This may be the case, for example, when both can storage facilities 50 and 51 are in form of roller conveyors on which the empty or full cans (e.g. flat cans 44) glide autonomously into the transfer point 501 or into the can delivery point 511 as a result of an appropriate incline. In this case the can receiving point 500 and the can delivery point 511 are naturally at different levels so that this height difference must be compensated at least at one these points during loading or unloading.

In the described embodiment, the two can storage facilities 50 and 51 serve to put cans, which are not needed immediately, in intermediate storage. Thus, an empty can (e.g. a flat can 44) taken from a spinning or twisting machine 11, 110, e.g. an open-end spinning machine 1 or some other textile machine, e.g. a circular knitting machine for the production of plush or carpet fabrics, is temporarily put in intermediate storage at the drawing frame 30 in the can storage facility 50 until the drawing frame 30 is able to fill this can. On the other hand, a newly filled can remains in the can storage facility 51 until it is needed by the machine or device treating or processing fiber slivers.

The replacement of the empty can by a flat can 44 at the same time in the same work cycle is, however, not limited to the u-shaped arrangement of the can storage facilities 50 and 51 as shown in FIGS. 2 and 6. Other arrangements are shown schematically in FIGS. 7 and 8.

FIG. 8 shows a linear arrangement of the can storage facilities 50, 51, transversely to the route 901 of the can conveying device 2, whereby a flat can 44 must be moved by means of an arc-like movement on the can conveying device 2. Here, the can conveying device is in the central plane between the two can storage facilities 50 and 51, as in the embodiment shown in FIGS. 2 and 6, but is not parallel to the can storage facilities but in a plane that is perpendicular to the longitudinal sense of the two can storage facilities 50 and 51.

As long as the can conveying device 2 (as in the embodiments shown in FIGS. 2, 6 and 8) is in the storage plane defined by the longitudinal extension of the can storage facilities 50 and 51, an identical movement of the same magnitude can be provided simultaneously for loading as well as for unloading of the can conveying device. In other words, to achieve this simultaneous loading and unloading of the can conveying device 2, it is necessary for the can receiving point 500 and for the can delivery point 511 to be placed symmetrically, with respect to the can conveying device 2 in can replacement position. The simplest loading and unloading movements are then achieved when the two can storage facilities 50 and 51 are parallel to each other, as shown in FIGS. 2 and 6.

FIG. 7 shows another linear arrangement of the can storage facilities 50 and 51, but contrary, to the embodiment shown in FIG. 8 it is parallel to the route 901 of the can conveying device 2 and perpendicular to the longitudinal extension of the flat can 44. The flat can 44, to be filled, is brought to the filling head 31 of the drawing frame 30 from the can storage facility 50 from the same side to which the filled flat can 44 is later unloaded to be put into the can storage facility 51. Such an embodiment presumes that the can receiving point 500 and the can delivery point 511 are at the opposite ends of the can storage facility 5. To be able to carry out simultaneous loading and unloading of the can conveying device 2 in this case, it is necessary for the can shifting device 7 (see FIGS. 3 and 6) to be divided into two shifting elements which are synchronized with each other by means of appropriate controls.

Figure 3:
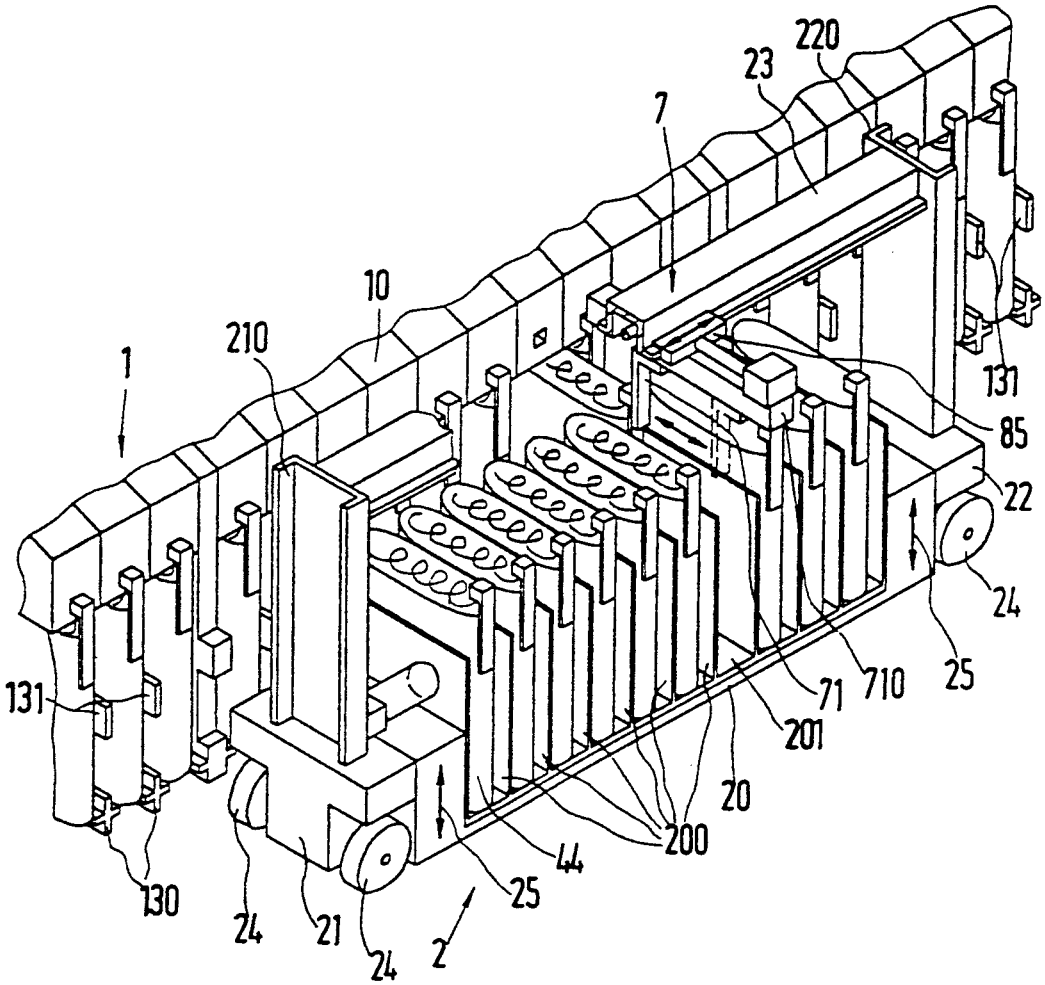
FIG. 3 is a perspective view of a group of spinning stations and a can conveying device for conveying flat cans and for replacing flat cans at the spinning stations.

According to FIG. 3 the can shifting device 7 is installed on the can conveying device 2, but this is not an absolute condition to carry out can replacement in particular, in an embodiment of the can storage facility 50, 51 according to FIG. 7, a stationary arrangement of the can shifting device 7, divided into two shifting elements may be very advantageous. One shifting element is used here to unload the can conveying device 2 while the other shifting element serves to load the can conveying device 2. Depending on the placement of the can storage facilities 50, 51, in relation to each other and/or to the can conveying device 2, it is possible to place the two shifting elements (not shown) also in one and the same working plane, perpendicular to the route of the can conveying device 2, e.g. in an embodiment as shown in FIG. 6.

Figure 9:
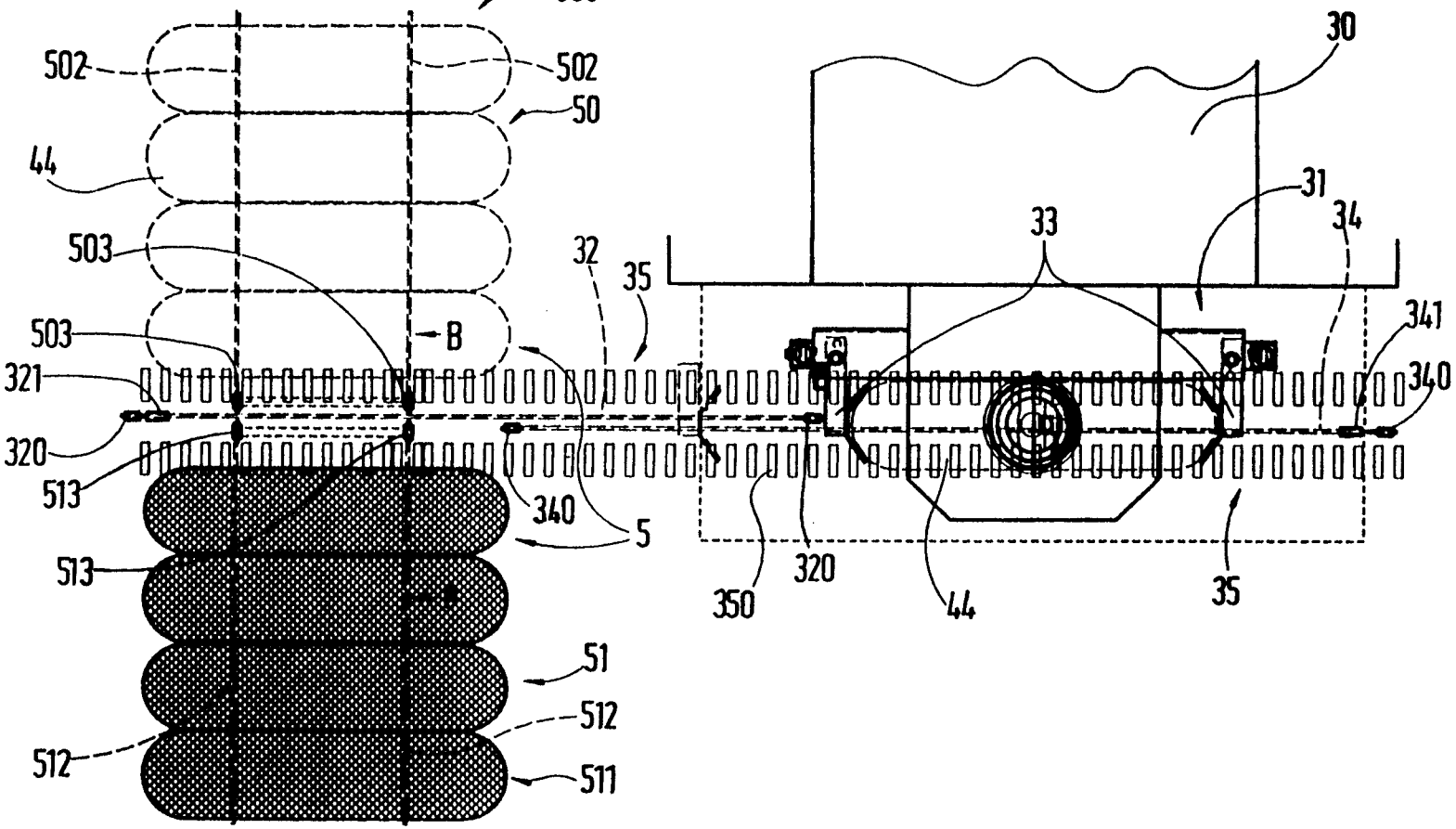
FIG. 9 is a top view of a drawing frame and two can storage facilities.

FIG. 9 shows such a device of FIG. 7 in greater detail. The two can storage facilities 50 and 51 are each assigned can shifting devices in form of conveyor belts or chains 502 or 512 which are deflected by means of deflection pulleys 503 or 513 in the immediate proximity of an additional conveyor belt or an additional conveyor chain 32. The conveyor belt or conveyor chain 32 extends from the can storage facility 5 into proximity of the filling head 31 of the drawing frame 30 and is deflected by means of deflection pulley 320. The conveyor chain 32 drives a catch 321 which engages the flat can 44 and conveys it into range of the filling head 31 where the flat can 44 is taken over by two arms 33 of can shifting means made in form of an alternating device. The arms 33 can be pivoted back out of range of the flat can 44 so that said flat can 44 may be brought back, by the conveyor belt 32, into the alternating range of the drawing frame 30, and arms 33 can, furthermore, be moved towards each other and constitute a grasper to be able to hold the flat can 44 firmly between them. The alternating device is required because, contrary to the filling of round cans by the filling head of drawing frame 30, the fiber sliver 4 cannot be distributed evenly in the flat can 44.

So as not to interfere with the alternating movement which is necessary to fill a flat can 44, the conveyor chain 32 is brought back from the alternating area of draw frame 30 and into its base position in which the catch 321 is located on the side of can storage facility 5 away from the drawing frame 30.

An additional conveyor chain 34 with a catch 341 which is deflected by deflection pulleys 340 is provided.

The deflection pulleys 320 are placed so that the catch 321 can be brought from the side of can storage facility 5 away from the drawing frame 30 into the immediate proximity of the filling head 31 for the reception of a flat can 44, so that said flat can 44 may then be received by the arms 33. The deflection pulleys 340 of the conveyor chain 34 are arranged so that the flat can 44 may be brought back into the can storage facility 5 by the catch 341, which is, at first, on the side away from the can storage facility 5. At the same time the conveyor chains 32 and 34 are parallel to each other over a certain distance so that their effective areas overlap. The two conveyor chains 32 and 34 constitute together a can shifting device to present and remove a flat can 44.

The can storage facility 5 is equipped with a horizontal can holding surface so that the can receiving point 500 and the can delivery point 511 may be on the same level. Thus, it is not necessary to overcome differences in height with the can conveying device 2, either at the can receiving point 500 or at the can delivery point 511 or at both these points. In the embodiment shown (in FIG. 9), the conveyor belts or conveyor chains 502 or 512 are designed in the form of roller bearing elements and are not equipped with any catch in the manner of conveyor chains 32 and 34 which function merely as pulling elements. For this reason roller conveyors 35 with a plurality of rollers 350 on which the flat can 44 is able to slide with ease are provided on both sides of the conveyor chains 32 and 34. As an alternative, it is also possible to provide driven rollers instead of conveyor belts or chains.

Figure 10:
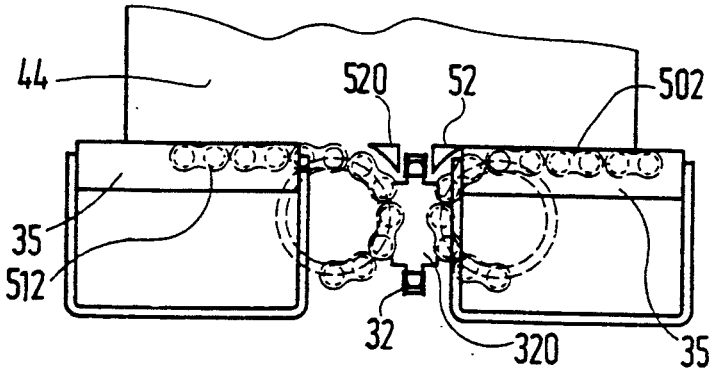
FIG. 10 is a detailed side view of the device shown in FIG. 9.

FIG. 10 shows a detail from FIG. 9, in a view taken along line B—B. As can be seen, at each transition point between the conveyor belts or conveyor chains 502 or 512 of the can storage facility 50 or 51 and the conveyor chain 32, filler pieces 52 or 520 which fill each interval are provided to ensure that the flat cans are not able to tilt as they pass from the can storage facility 50 into the area of the conveyor chain 32 or as they pass from the arc of the conveyor chain 32 into the can storage facility 51.

As stated earlier, the filled flat cans 44 must be brought to the spinning or twisting machine 11, 110 (see FIG. 2), e.g. to open-end spinning machines 1 (see FIG. 1) in order to be exchanged for empty flat cans 44. In order to be able to describe this in greater detail, reference is again made to FIG. 3.

FIG. 3 shows twenty-three spinning stations 10 of an open-end spinning machine 1 as well as a can conveying device 2 to convey and to exchange flat cans 44 at the spinning stations 10.

The can receiving element 20 of the can conveying device 2 is subdivided by intermediate walls 200 into compartments 201, with each compartment 201 being suitable for the reception of a flat can 44, effected through a movement of said flat can 44 in its longitudinal sense.

The can shifting device 7 can be presented to the individual compartments 201 of the can-receiving element 20 by travelling along beam 23. In the exchange movements of the flat cans 44 the latter are guided onto the can conveying device 2 by the intermediate walls 200. Also, in the open-end spinning machine 1 (or other spinning or twisting machine 11, 110) the flat cans 44 are guided by guides 130 and 131 located near the upper and/or lower end of the flat can 44.

The can conveying device 2 is guided by plant controls, which shall be discussed in greater detail further below to a selected spinning station 10 where the flat can 44 is to be replaced. By means of an appropriate positioning system (not shown here) the can conveying device 2 is first positioned so that its empty compartment 201 is lined up with the spinning station 10 at which the flat can 44 is to be replaced. The can shifting device 7 is assigned to the empty compartment 201 of the can conveying device 2 and the can pusher 71 is moved in the direction of the machine so that its grasper (not shown) is able to grasp the empty can 44 which is to be replaced. The flat can 44 to be replaced is pulled into the previously empty compartment 201 of the can conveying device 2 by a movement of the can pusher 71 away from the machine (see also FIG. 12).

The can conveying device 2 is then moved on in order to align a compartment 201 of the can conveying device 2 occupied by a full flat can 44 with the corresponding spinning station 10. By moving the can shifting device 7 in the direction of spinning station 10, this flat can 44 is then moved into operating position.

The can conveying device 2 can now be presented to another selected spinning station 10 where the process is repeated, and whereby the empty compartment 201 of the can conveying device 2 is now no longer at its original place but at the location of the full flat can 44 which was last transferred to the machine. By repeating this process the empty compartment 201 is shifted step by step until all the full flat cans 44 have been introduced into the open-end spinning machine 1 and have been replaced by empty flat cans 44 (or at least cans requiring replacement). The can conveying device 2 is then moved back to draw frame 30.

The can receiving element 20 of the can conveying device 2 need not be connected rigidly to the end elements 21, 22 of the can conveying device 2. As indicated in FIG. 3 by double arrows 25, element 20 may also be mounted so as to be adjustable in height in relation to the end elements 21, 22 so as to be able to move the flat cans 44 at the same level from element 20 into their loading or unloading position at the draw frame 30 or open-end spinning machine 1 or some other textile machine or device, and of course also in the opposite direction.

The can conveying device 2 may, in principle, be of different design, e.g. in form of a car able to travel on a railway (not shown). However, it is preferably designed in the form of a floor vehicle travelling on rails or without rails.

Figure 4:
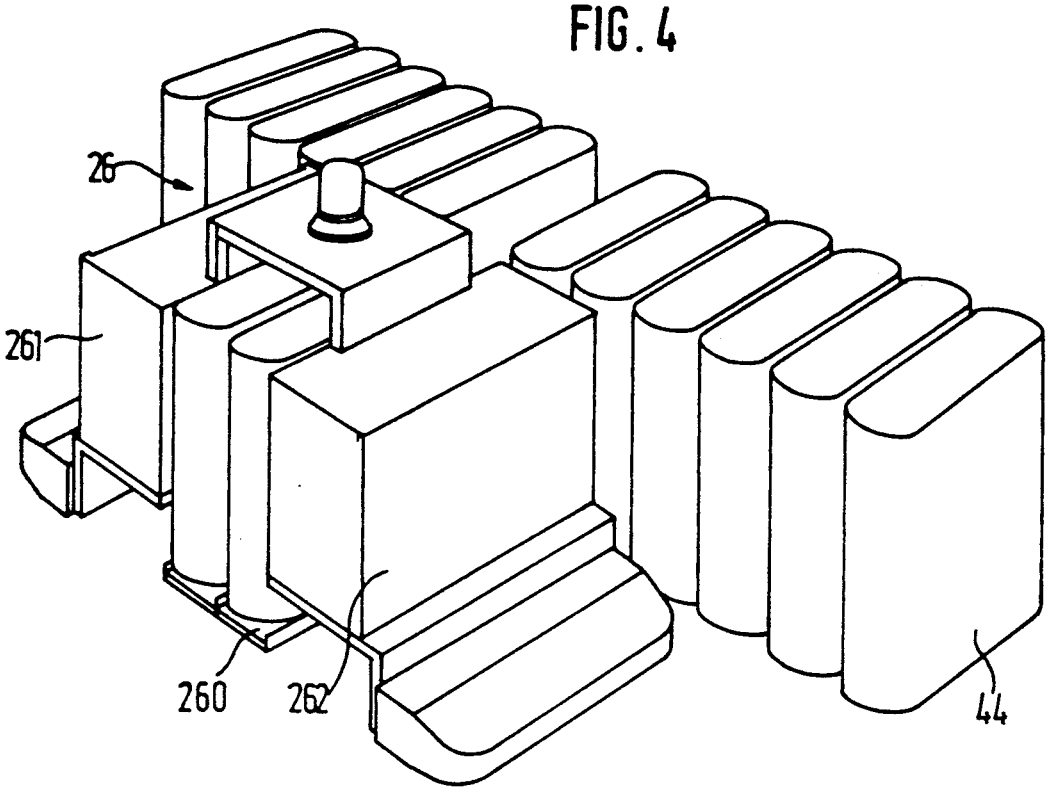
FIG. 4 is a perspective view of a can conveying carriage in front of a row of cans.

FIGS. 4 and 11 show a can conveying device 26 in form of a floor vehicle which is different in design from the can conveying device 2 shown in FIG. 3.

The can conveying device 26 according to FIGS. 4 and 11 has a can receiving element 260 and two end elements 261 and 262. The can receiving element 260 has, in all, only two can holding surfaces 263 and 269, i.e. one can holding surface 269 which is normally occupied by a can 43 or 44 (full or empty) as well as a second can holding surface 263 (shown in broken line) which is kept empty to receive a can 43 or 44 (full or empty). The two end elements 261, 262 are provided with wheels 24 of which at least one set can be steered. Preferably, both sets of wheels are steerable so that the can conveying device 26 can be moved in both directions, also at a perpendicular to the longitudinal axis of the received cans 43 or 44. The end elements 261, 262 contain electric drives (not shown in FIGS. 4 and 11). Furthermore, each end element 261 or 262 supports can shifting devices 70 or 700, shown only schematically in FIG. 11 but which shall be described in further detail below in connection with FIGS. 22 to 25.

The two can shifting devices (elements) 70 and 700 are placed one behind the other at a distance from each other equal to the width of the can holding surfaces 263, 269 and are able to move in two planes, which can be moved at a perpendicular to the route of the can conveying device 26. Both can shifting devices (elements) 70 and 700 can also be controlled independently of each other, as shall be seen from the following description.

The can conveying device 26 is built to carry out travel commands, whereby the can conveying device leaves the draw frame 30 (see FIGS. 1 and 2) with one full can 43 or 44 and follows a fixed route 901 to a selected spinning station 10. Upon arrival at the spinning station 10, where the exchange of cans is to be carried out, one can holding surface 263 is empty, while the other can holding surface 269 is occupied by a full can 43 or 44. The exchange of cans by the can shifting device 700 now takes place in that, first, an empty can 43 or 44 is loaded by means of the can shifting device 700 (FIG. 11) from the spinning station 10 in question (see also FIG. 3) to the can holding surface 263 of the can conveying device 26, in that the latter is then moved on by one spinning station division and, in that, the full can 43 or 44 is then brought from the can holding surface 269 of the can conveying device 26 to the liberated point below the spinning station 10 (see also FIGS. 12 and 13), so that the can holding surface 269 on the can conveying device 26 now becomes free. The can holding surface below the spinning station 10 is, thereby, at the same time a can delivery and a can receiving surface.

Upon completed can replacement, the can conveying device 26 travels back to the draw frame 30 in order to exchange the empty can 43 or 44 and in order to then receive the next travel command. The vehicle controls are provided with sufficient intelligence (computer capacity) to be able to carry out a travel command without requiring additional information or messages with a master computer, so that a continuous communication connection between the master computer and the can conveying device can be omitted.

Figure 23:
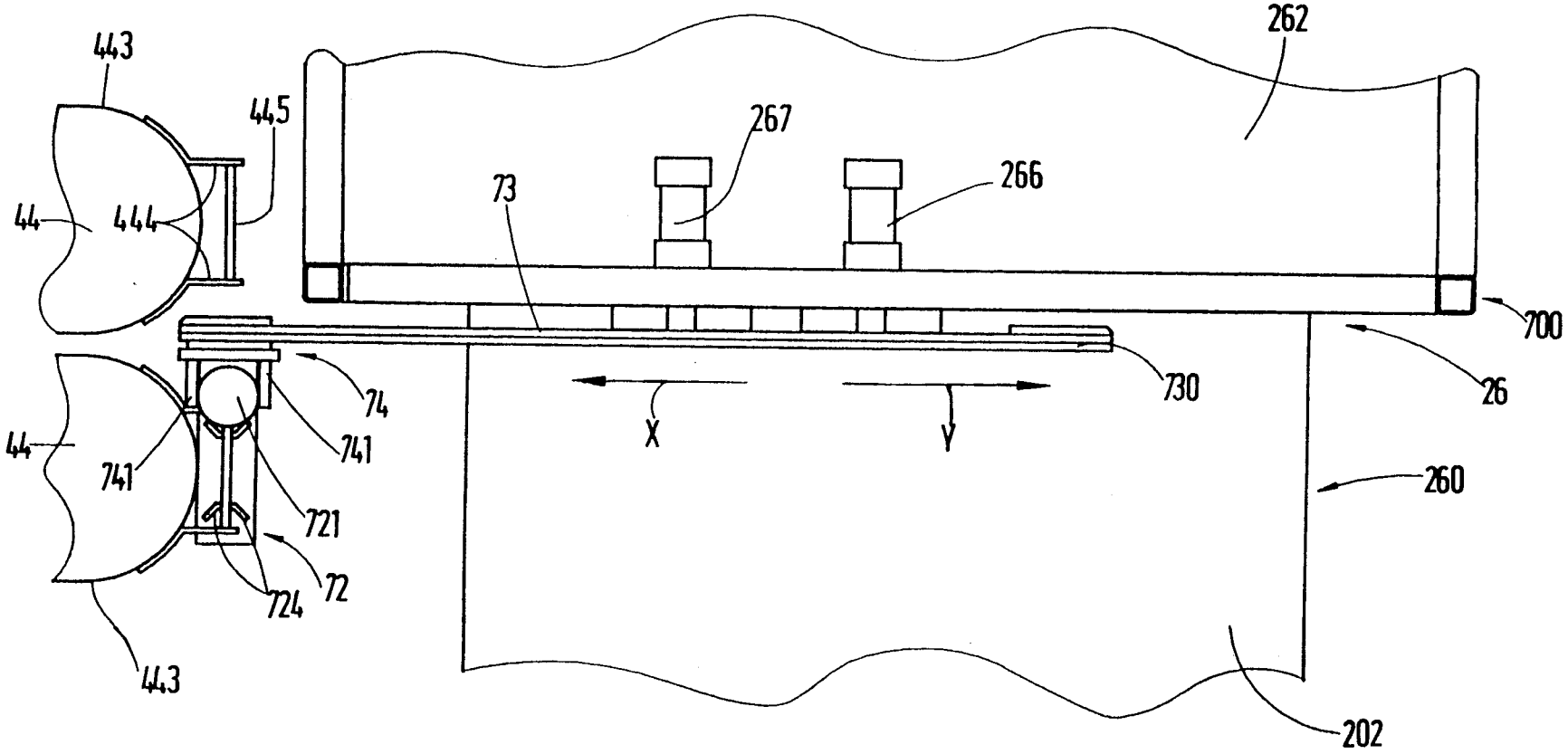
FIG. 23 is a top view on a can conveying device at a spinning or twisting station.

The can shifting device 700 shall now be described in detail through FIGS. 23 to 26. FIG. 23 shows a top view of such a can shifting device 700 together with the end elements 443 of two flat cans 44.

Each end piece 443 of a flat can 44 is provided with two brackets 444 and with a projecting piece in form of a support piece 445 which serves to interact with the can shifting device 700 as shall be described below in further detail. It is assumed that the can conveying device 26 (FIG. 11) with the can shifting device 700 (similar to FIG. 12) is positioned across from a selected spinning station 10 for the exchange of flat cans 44.

As has already been explained through FIGS. 4 and 11, the can conveying device 26 is provided with two can holding surfaces 263 and 269. For each can holding surface 263 or 269 its own can shifting device 70 or 700 is provided on the can conveying device 26 as is indicated in FIG. 11, so that the loading and the unloading process can be carried out from the can conveying device 26.

The two can shifting devices 70 and 700 are mirror images of each other. Merely the can shifting device 700 is described below through FIGS. 23 to 26, as the structure and function of its components are exactly identical to those of the can shifting device 70.

Figure 24:
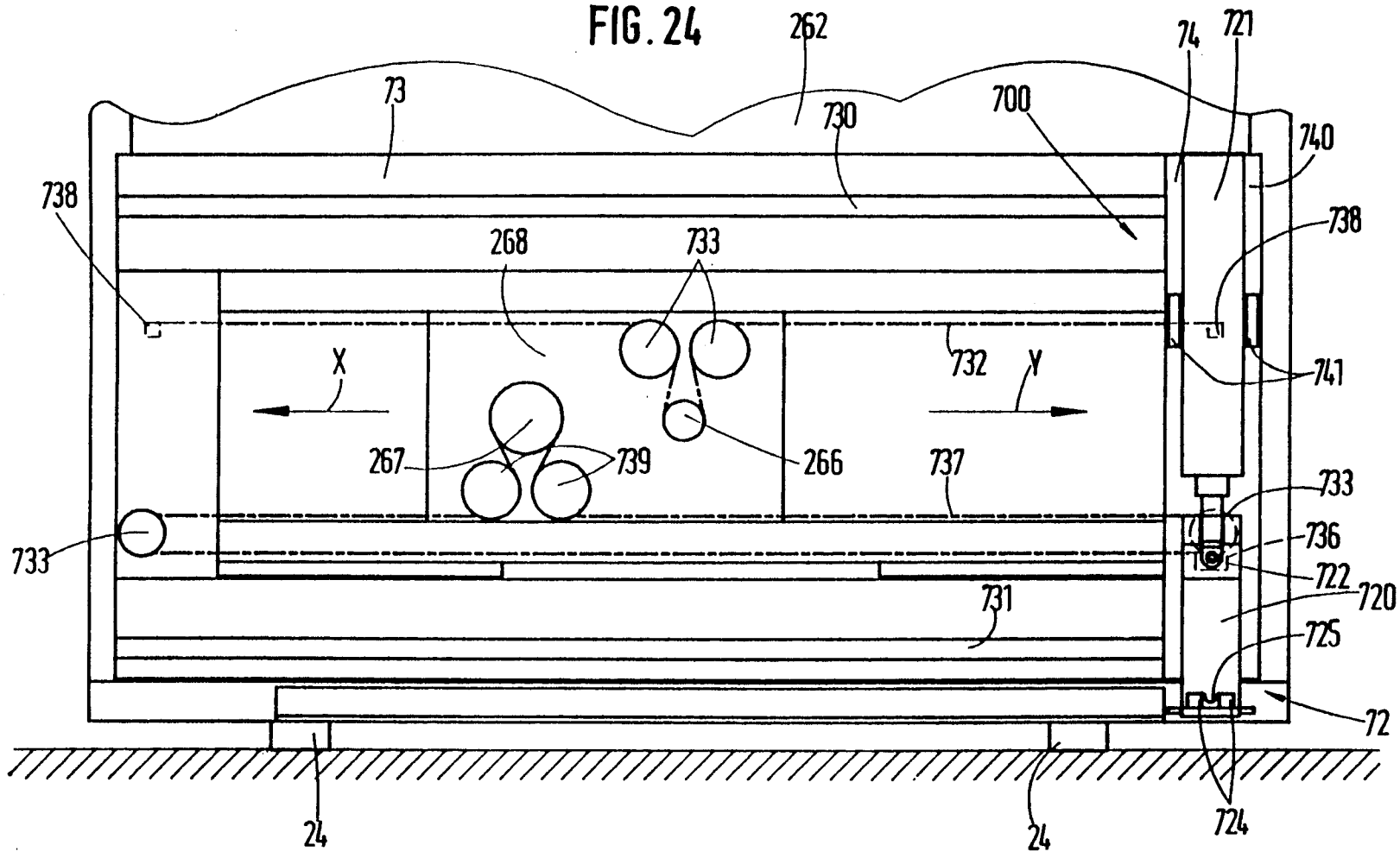
FIG. 24 is a side view of the can conveying device shown in FIG. 23, in a different working position.
Figure 25:
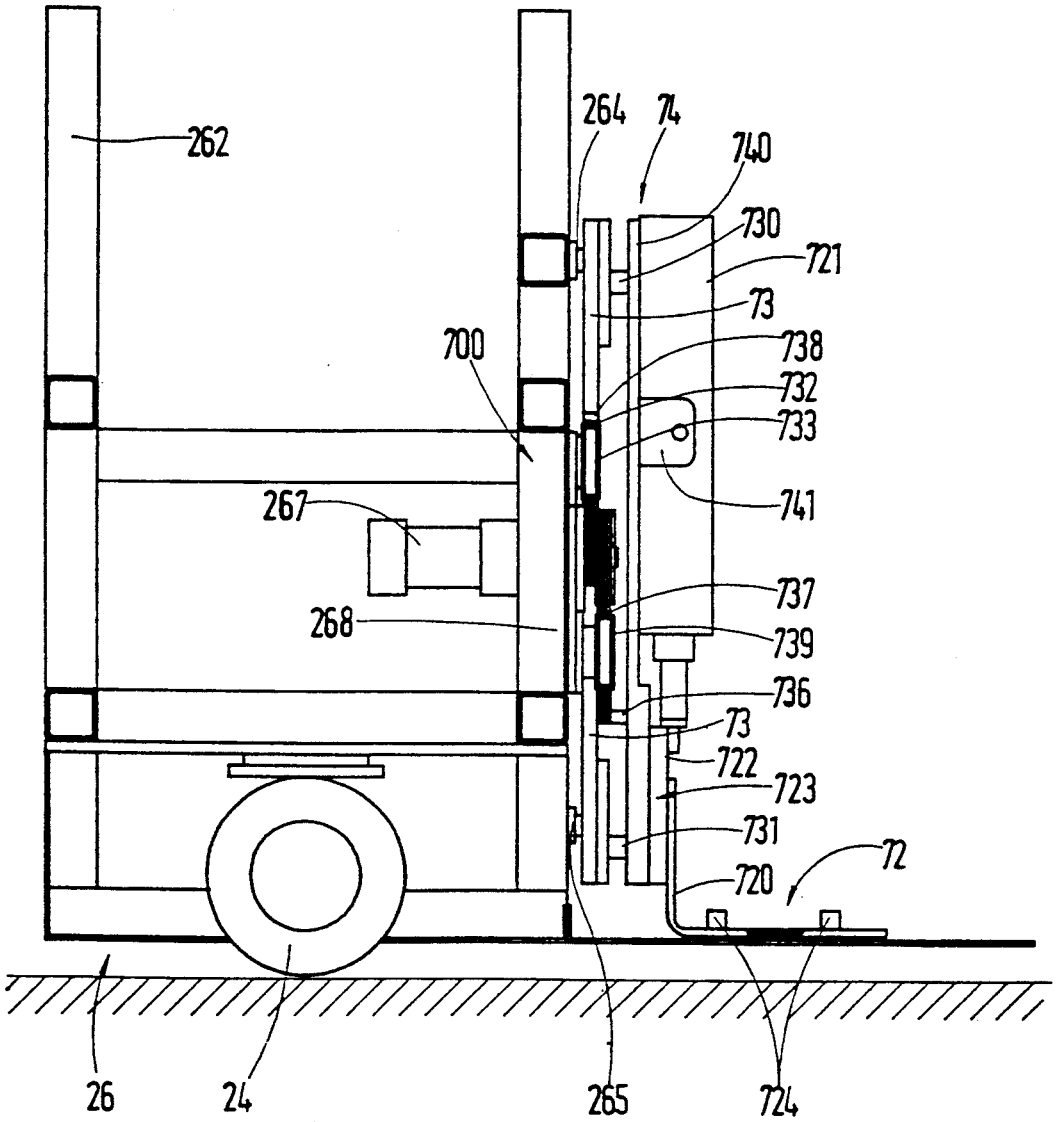
FIGS. 25 is a cross-sectional view taken on line A-A in FIG. 24.

At the end element 262 of the can conveying device 26, of which FIG. 25 merely shows a portion and which is assembled in the embodiment shown in the manner of a "skeleton" in light assembly, two rails 264 and 265 are located at different heights, and on them a bearing sled 73 is mounted in such manner as to be capable of being shifted. A toothed belt 732 is connected to the two ends of this bearing sled 73 capable of moving transversely to the longitudinal axis of the can conveying device 26, as is indicated in FIG. 24 by a broken line by the attachment elements 738. A motor 266, e.g. a stepping motor serves as a drive of the toothed belt 732, the motor being supported on a plate 268 of the end element 262 in the same manner as another motor 267, which may also be made in the form of a stepping motor and the role of which shall be explained further below. The motor 266 of which only one drive roller can be recognized in FIG. 24, drives the toothed belt 732 which is deflected over deflection pulleys 733, which are also attached on the plate 268, and is thereby held in engagement with the drive roller of the motor 266, whereby a surrounding loop of over 180° is produced by the two deflection pulleys 733.

Depending on the direction of rotation of the motor 266, the bearing sled 73 can, thus, be moved from one end of the guide rails 730, 731 to the other end and back, i.e. in one direction (see arrow X) or in the opposite direction (see arrow Y), at a perpendicular to the longitudinal extension and direction of travel of the can conveying device 26.

The can shifting device 700 is provided with a grasping device 72 and a can pushing device 74 in the form of a carrier which is made in the form of a trolley (sled) for back-and-forth movement on the bearing sled 73. The can pushing device 74 moves in the one direction (arrow X) toward the open-end spinning machine 1 (FIG. 3) and in the other direction (arrow Y) away from the machine. The second motor 267, drives an endless toothed belt 737 which is deflected by means of deflection pulleys 739 attached to the end element 262 is provided for this movement. The toothed belt 737 supports a catch 736 by which the can pushing device 74 is connected to said toothed belt 737.

Two deflection pulleys 739 are provided on plate 268 for the toothed belt 737.

The motor 267 is driven, in addition to the motor 266, to produce the movement of the can pushing device 74 in the direction of one of the arrows X or Y so that the can pushing device 74 executes a movement relative to the bearing sled 73. The can pushing device 74 is able to travel at both ends of the bearing sled 73 but does not rise above them in any of its possible positions.

Since the bearing sled 73 can also be moved in relation to the can conveying device 2, the latter is able to maintain a certain distance from the open-end spinning machine 1 without impairing the replacement process. The drives shown going over the toothed belts 732, 737 make it possible to mount the drives fixedly on the end elements 261, 262 of the can conveying device 2.

The bearing sled 73 supports one upper and one lower guide rail 730 or 731 at different heights, and on these the can pushing device 74 with its bottom plate 740 is suitably supported, e.g. by means of track rollers, in such manner as to be capable of being shifted. The bottom plate 710 supports a lifting device 721 which may be designed in the form of a lifting cylinder for example, between two bearing arms 741 which are attached to the bottom plate 710 which can be moved vertically by the lifting device 721 and constitutes a lifting column.

The toothed-wheel disks (not shown) of the motors 266 and 267 penetrate through the bearing sled 73, limiting the freedom of movement of bearing sled 73 so that it is able to extend out of the can conveying device 26 over only a limited distance. This also applies to the can pushing device 74 bearing a grasping device 72 and mounted on the bearing sled 73 in such manner as to be capable of being shifted. The transversel translation movements of the bearing sled 73 and the can pushing device 74 are completely independent of each other due to the separate motors 266 and 267. However, in the case where the can pushing device 74 must not move in relation to the bearing sled 73 while the bearing sled 73 must, nevertheless, move in relation to the can conveying device 26, the drive of the can pushing device 74 must compensate for the drive of the bearing sled 73.

Inductive as well as mechanical end switches can be used for the can pushing device 74 and the bearing sled 73.

The overall controls of the can conveying device 26 are installed on the can conveying device.

The grasping device 72 has an L-shaped yoke 720 (FIG. 25) and the earlier-mentioned lifting device 721 which is attached on the can pushing device 71 at its lower end. The yoke 720 is connected via a pivot axle 722 to the lifting device 721, whereby a sliding guide 723 is provided to transfer the torque forces exerted upon the grasping device 72 directly (instead of via lifting device 721) to the can pushing device 74.

The yoke 720 is, furthermore, provided with two projections 724 protruding upward, each with a recess 725 (FIG. 24).

When an empty can (e.g. flat cans 44) is to be replaced at the spinning station 10*b* by a full can, the can conveying device 26 travels to the spinning station 10 concerned and stops there in such a manner that its empty can holding surface 263 is directly in front of the spinning station 10 at which the can replacement is to be carried out.

The bearing sled 73 now travels on rails 264 and 265 transversely to the can conveying device 2*b* and out of the can conveying device 2*b*. On bearing sled 73 the can pushing device 74 travels transversely to the can conveying device 2*b* and out of the can conveying device 2*b* at high speed until it is just in front of the can and is at the same time lowered to the floor. The can pushing device 74 then travels the last centimeter at low speed and pushes the can 44 easily under the open-end spinning machine.

1. In this process the yoke 720 with its projections 724 comes under the support piece 445 at the lower end of the flat can 44 to be replaced. This ensures precise horizontal positioning of the grasping device 72.

The grasping device 72 now rises and lifts the can slightly. The support piece 445 is received at the same time in the recesses 725, whereupon slight continued lifting of the yoke 720 leads to a "tilting" of the flat cans 44 around their end element 442 (see FIG. 5) shown in FIG. 23 meaning that the flat can 44 is tilted at a slight angle to be received on the can conveying device 26.

The bearing sled 73 and the can pushing device 74 are now pulled back (to the right according to FIG. 23) and the flat can 44 is thereby pulled out of its position under the spinning station 10 and is placed on the holding surface 202 (can holding surface 263—see FIG. 11) of the can-receiving element 260 of the can conveying device 26. The slight tilt of the flat cans 44 during loading of the can conveying device 2*b* prevents a collision between the lower can edge and the edge of the can-receiving element 260 of the can conveying device 26.

The bearing sled 73 and the can pushing device 74 with the grasping device 72 travel into the can conveying device 26 so far that the can finally stands centered on the can conveying device 26. The can is then lowered.

The can conveying device 26 is now shifted by one spinning station division (=distance from spinning station 10 to spinning station 10) which is substantially equal to the distance between the can holding surfaces 263 and 269 of the can conveying device 26, and thereby from the can holding surface of the machine to the can holding surface in order to bring the full can (flat can 44) in front of the spinning station 10 from which the empty can was previously removed. During the subsequent unloading of the full can and during its transfer to the open-end spinning machine 1 by means of the can shifting device 70, the full can is not lifted but is only pushed out by the can pushing device 74. The bracket 444 and the support piece 445 are attached at the lower edge of the flat cans 44 while the grasping device 72 runs as close as possible to the holding surface 202.

The projection on the can which is made in form of a support piece 445 in the embodiment shown and serves to interact with the corresponding grasping device 72, may also be of a different design, e.g. in form of one or two cylindrical projections or in form of a rectangular block with a recess on the underside.

Neither do the cans require any special can receiving means in the vertical direction under the spinning machine. The frame of the open-end spinning machine 1 may, however, be provided with the lateral guides (see FIGS. 3 and 4) with a certain amount of clearance in order to prevent lateral tipping of the flat cans 44 during the above-described movements.

Since the can (e.g. flat can 44) in the embodiment shown in constantly pulled or pushed in a sliding manner over the floor it is an advantage to provide wear-proof sliding edges either on the can or on the corresponding can holding surfaces 263 and 269. If guides are provided on the open-end spinning machine 1 (see FIGS. 3 and 4), these are also advantageously of wear-proof design, i.e. made of polyethylene. This also applies to other can holding surfaces outside the can conveying device 26, i.e. not only on the machine but also in the can storage facility.

The can shifting device 700 has been shown and described in reference to FIGS. 22 to 25 for can replacement to the left. An identical can shifting device may also be provided for can replacement to the right side or for selective can replacement to the right side or to the left side. In such case, the bearing sled 73 is extended to the right whereby the already described movements of the can pushing device 74 and of the grasping device 72 are executed. While the can holding surface assigned to a given can shifting device 70 or 700 is still unoccupied, the can shifting device 70 or 700 is driven selectively for replacement on one or the other side. However, if the can shifting device 70 or 700 has already moved a flat can 44 from the left side (or from the right side) to the can conveying device 2, a flat can 44 must also be delivered to the same side, i.e. to the left (or to the right).

The delivery of a flat can 44 to the open-end spinning machine 1 is effected by shifting the flat can 44 from the holding surface 202 in a direction that is perpendicular to the longitudinal plane of the machine. The holding surface 202 in the can conveying device 2*b* may be slightly higher than the holding surface in the machine. This slight difference in height is overcome during loading of the can conveying device 2*b* by lifting the end element 443 of the flat cans 44 by means of the lifting device 721.

Figure 26:
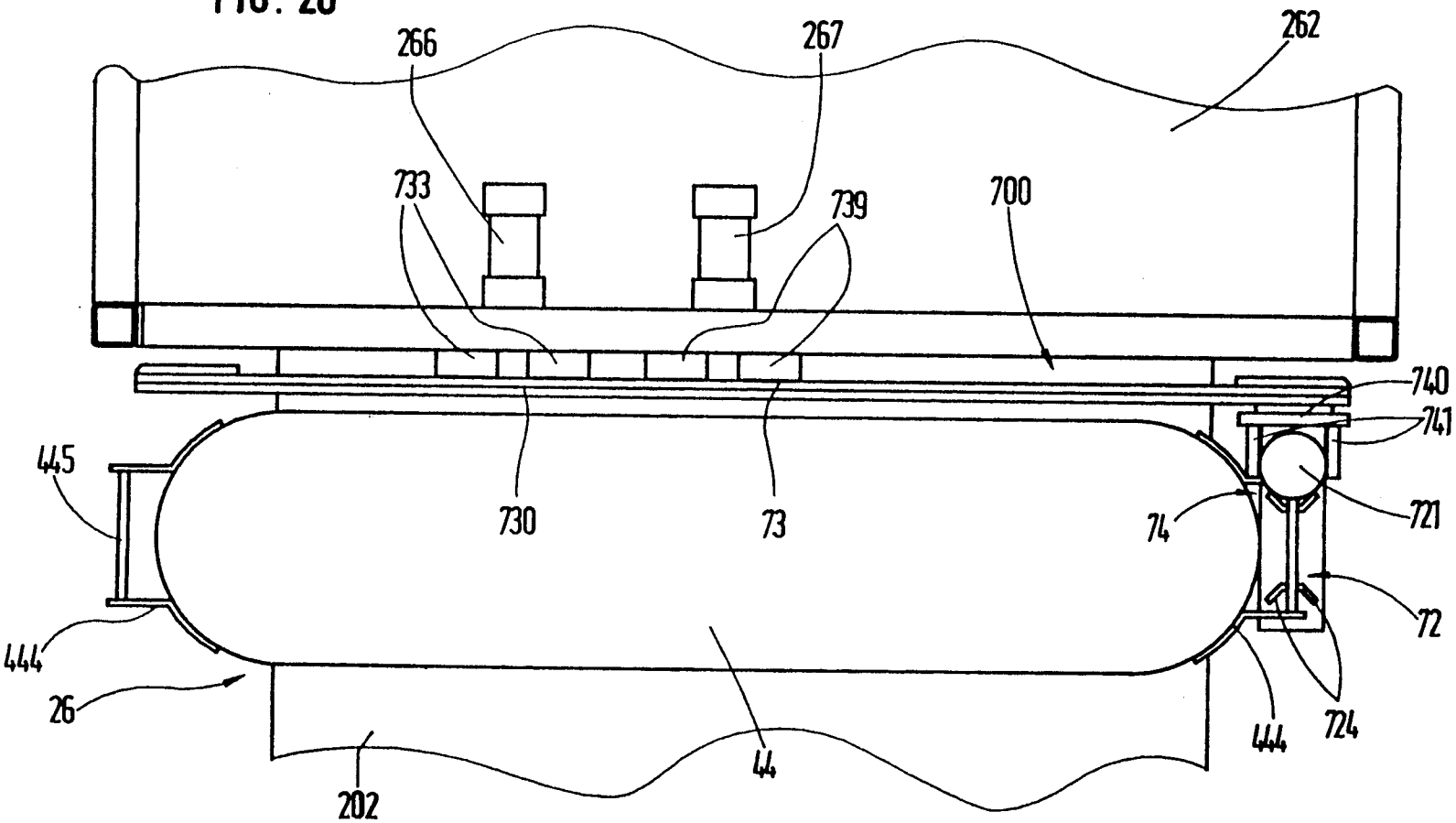
FIG. 26 is a top-view, similar to FIG. 23, but in a different working position.

FIG. 26 shows the device shown in FIG. 23 in its end position after the flat can 44 has been placed the can conveying device 26. The bearing sled 73 which can be shifted at a right angle to the longitudinal extension of the can conveying device 26 serves to bring the grasping device 72 into range of the support piece 445 of the flat can 44, without need to change its distance from the flat can 44 located under the spinning station 10. The actual pulling movement then takes place through shifting of the sled-shaped can pushing device 74 on the bearing sled 73, whereby the bearing sled 73, however, returns into its base position.

In order to avoid excessive lifting movements for the loading of the can conveying device 26, as small a height difference as possible must be provided between the can holding surfaces (can holding surfaces 263 and 269) of the can conveying device 26 and of the machine or device treating or processing fiber slivers 4 and/or the can holding surfaces of the can storage facilities 50, 51, i.e. the can receiving point 500 and the transfer point 501. This difference in height should not exceed 100 mm but should be even less and, if possible, should not even exceed 40 mm. When all of the can holding surfaces on the can conveying device 26, and elsewhere, are at the same horizontal level, this is especially advantageous for the can replacement or for the loading and unloading of cans.

The small or non-existent difference in height between the different can holding surfaces can be achieved by a small distance A between the can-receiving element 260 of the can conveying device 26 and the floor (see FIG. 11) or by means of pedestals 53 or 530 (see FIG. 17) at the same height as the upper side of the can-receiving element 260 of the can conveying device 26.

In the installation shown in FIGS. 1 and 2, the can conveying device **2*b* runs directly between a spinning station 10 and the draw frame 30. To make sure that only perfect and perfectly filled cans 43 or 44 go from the draw frame 30 to the open-end spinning machine 1 or other machines, e.g. spinning or twisting machines 11 or 110, the full can is inspected on its way between the spinning or twisting machine 11 or 110 and the draw frame 30 or between the draw frame 30 and the spinning or twisting machine 11 or 110**, i.e. before the transfer of the can to the machine, for its physical condition, i.e. with respect to possible damage that could affect the further processing of the sliver, and/or with respect to its fullness.

Damage to a can may have different causes, so that its continued use in an automatic system may no longer be desirable. Such a can may still contain a considerable amount of fiber sliver, for example, due to a sliver breakage in operation.

It is, therefore, advantageous to inspect the cans to ascertain that no malfunctions will occur due to damage if they continue to be used.

Inspection can, of course, be carried out by the operator, but he can only carry out spot-checks in an automated plant, and this is not satisfactory. It is, therefore, better if a can inspection station is located along the route of the can conveying device 2 or 26, so that the inspection of the cans may take place along the route. Thus, the can conveying device **2*b*** itself may be equipped with a can inspection station (not shown).

When such defects or faults are detected by a can inspection station installed on the can conveying device 2 or 26, it is possible for the can to be pushed out of the can conveying device 2 or 26 at a suitable location in the installation, and a new can must be taken up in order to maintain an optimal number of cans in the system. For this purpose, appropriate intermediate storage facilities are provided in the installation as buffer storage installations in which empty and full cans and, cans to be inspected or which have been eliminated, can be stored.

FIG. 14 shows an arrangement of the installation in which the can conveying device 2 does not go directly into the preparation phase (draw frames 30 and 36) upon its return from a rotor spinning or other machine, but goes first into a can inspection station 6 and delivers the cans 43 or 44, which it has received, to can inspection station 6 for inspection.

The installation, according to FIG. 14, comprises more than one machine with a filling head 31, i.e. two drawing frames 30, 36 and also more than one other machine or device treating or processing fiber slivers, i.e. four spinning or twisting machines 11, 110, 111 and 112 as well as a connecting route (route 91) to which the spinning or twisting machines 11, 110, 111 and 112 are connected via bifurcation routes 910 to 917 and the drawing frames 30 and 36 are connected via bifurcation routes 918 and 919. The can inspection station 6 already mentioned earlier is located along route 91 of the can conveying device 2.

Controls 8, in the form of a master computer, are provided to issue the travel commands for the can conveying device 2, and to monitor or control can management within the installation. For this purpose, the controls 8 (master computer) are connected via data circuits 80 to the drawing frames 30, 36 via data circuits 81 to the spinning or twisting machines 11, 110, 111 and 112 and via data circuit 82 to the can inspection station 6.

The controls 8 are thus connected to all the machines belonging to the installation. In the embodiment shown, they service, for instance, to determine which drawing frame 30 or 36 is to be approached in the execution of a travel command emitted by the spinning or twisting machine 11, 110, 111 and 112 for the can conveying device 2, whereby the controls 8 must take into account the operating conditions of the drawing frames 30, 36 (or their can storage facilities). The next travel command must be transmitted to the can conveying device 2 before it starts its journey to a drawing frame 30 or 36, e.g. when leaving the can inspection station 6. It is also possible to effect such a communications connection between the controls 8 and the can conveying device 2 so that the controls 8 are able to intervene at any time in the "travel plan" of the can conveying device 2.

FIG. 15 shows, at its left side, controls in a machine installation as shown in FIG. 14 and on its right side a similar installation whose individual elements bear the same reference numbers as the corresponding elements on the left in FIG. 15, but are modified by the letter "a". The can inspection station 6 (and also the can inspection station **6*a* which is not shown in as much detail as the can inspection station 6) comprises, in addition to the can inspection station 61, three can storage facilities (can magazines 600, 601 and 602), of which the can magazine 600 serves for the storage of full cans 43 or 44, the can magazine 601 for the storage of empty cans 43 or 44 and the can magazine 602 for the storage of unusable, defective cans 43 or 44. The can magazine 601 contains a can emptying device 62** which shall be described in greater detail further below.

The can magazine 600 and 601, which are installed independently of machines or devices treating or processing fiber slivers, and in which the cans may be moved by shifting them or in some other manner so that they may be taken up from the can conveying device 2, when required, need not be connected to the controls 8 since loading or unloading of cans is controlled on the can conveying device 2, which is connected for control to the controls 8, in an appropriate manner. The can emptying device 62, on the other hand, is connected to the controls 8 so that incompletely emptied cans 43 or 55 may be emptied. The can emptying device 62 is assigned a conveying device 620 which is shown only schematically, by means of which the residual material emptied from cans 43 or 44 can be conveying to an additional material-collection station 621.

If desired, and in case the can magazines 600 and 601 are at a further distance from the can inspection station 6, the can emptying device 62, instead of being part of the can magazine 601 as described, may be part of the can inspection station 6. It is also possible to present one can emptying device 62 at a time to the can inspection station 6 and to the can storage facility (can magazine 601).

The can magazine 602 can also be provided with a can emptying device 62 in order to remove possible sliver remnants from rejected cans. The cans which cannot be put in order are excluded from further transportation to a machine or device treating or processing fiber slivers. An inspection by the operator is now required to decide whether it is possible to put a can in order again or whether it should be excluded from further utilization.

An example of a can emptying device 62 shall be described in greater detail further below.

If the inspection is carried out on the can conveying device 2 or 26, the can 43 or 44 always remains on the predetermined route of the can conveying device 2 or 26. This is also the case if the can inspection station 6 is along one of the routes 91 or 910 to 919 and the can remains on the can conveying device 2 or 26 during the inspection.

An embodiment has been described in which the can inspection station 6 is located either on the can conveying device 2 or 26 or, independently thereof, along the route 91 of the can conveying device 2 or 26, but in which the can may be removed from the can conveying device 2 or 26 for inspection. The can 43 or 44 is taken out of the predetermined route of the can conveying device 2 or 26 for inspection and is returned after inspection to the can conveying device 2 or 26, possibly when this can conveying device 2 or 26 goes by again. As a rule, however, the can conveying device 2 or 26 must be filled with an already inspected can after the surrender of a can, so that the can conveying device 2 or 26 may be fully occupied, and so that the optimal number of cans may be in circulation.

As shown in FIG. 15, the route 91, together with routes 92 and 93, constitute a transportation system for the can conveying device 2. At the same time, the routes 91 and 910 to 919 constitute a (possibly open) circuit I (see FIG. 16) between two machines or devices treating or processing fiber slivers, i.e. between the drawing frames 30 and 36, on the one hand, and the spinning or twisting machines 1, 110, 111 and 112, on the other hand. The routes 92, 920, 910 to 917 and part of the route 91 constitute an open circuit II which comprises one of these machines or devices treating or processing fiber slivers, i.e. a spinning or twisting machine 11, 110, 111 and 112 and the can storage facility, i.e. the can magazine 600. A third can circuit III consists of the routes 93, 930 as well as of part of the routes 91 and 918 or 919, and also connects a machine or device treating or processing fiber slivers, i.e. a drawing frame 30 or 31 to a can storage facility, i.e. the can magazine 601.

As stated, the can inspection station 6*a* with its can magazines is identical in construction with the can inspection station 6. Thereby, the installation shown on the right side on FIG. 15 with drawing frames 30*a* and 36*a* and with the spinning or twisting machines 11*a*, 110*a*, 111*a* and 112*a* also consist of a transportation system consisting of three can circuits Ia, IIa, IIIa. FIG. 15 shows, furthermore, that the controls 8*a* are also connected to the can inspection station via two data circuits 82*a* and 83*a*, of which data circuit 82 connects the controls 8*a* to the inspection unit (corresponding to inspection unit 61) and emptying device (in accordance with data circuit 83 between the controls 8 and the can emptying device 62).

Both installations (the one shown on the left in FIG. 15 as well as the one shown on the right in FIG. 15) normally operate completely independently from each other. If required, however, the two installations may be connected with each other. As shown in FIG. 15, the routes 91 and 91*a* are connected to each other via routes 94 and 940. Through manual intervention in one or both controls 8 and 8*a* or through a data exchange over the data circuit 84, the connection can be put into effect and an exchange of cans 43 or 44 may be carried out between the left and the right installation as shown in FIG. 15. This may be an advantage in case of malfunctions in one or the other of the two installations. It may also be useful when the can magazines 600 or 601 or the corresponding can magazines in the other installation are overloaded because of some malfunction so that such an exchange of cans makes it possible to continue smooth operation.

It is, of course, necessary that this malfunction be pointed out by a signal device. Such signal devices are shown schematically in FIG. 15 in connection with the can inspection station 6. The magazine is for example monitored by means of a sensor 63 or 630 which is connected to a warning light 64 or 640.

The installation described through FIGS. 14 and 15 can be controlled in different manners, as desired, and this is achieved autonomously by the controls 8 in that the individual can circuits I, Ia, II, IIa, III, IIIa are laid out individually as needed. If, for example, a full can will be shortly needed at the spinning or twisting machine 110 and enough or even almost too many full cans stand ready in the can storage facility 51 of the drawing frame 36, the circuit I between the drawing frame 36 and the spinning or twisting machine 10 is determined with attention while taking into consideration whether the needed can is to be delivered over route 912 or 913 to the concerned spinning station 10. If the can storage facilities 50, 51 on the drawing frame 30 or 36 are full, the cans which are not needed at the moment, are taken for intermediate storage into the general can storage facility, e.g. the can magazine 600 or 601, with the appropriate route at a machine belonging to the installation and the route leading to the appropriate can storage facility (can magazine) being selected.

If desired, the can may thus be brought directly from a machine or device for treating or processing fiber slivers 4 to another machine, where can inspection may possibly be waived in order to avoid delays in the delivery of the can to the machine which needs the can. On the other hand, when a can storage facility (can magazine) is approached, the fact that a can exchange takes place there, i.e. that the can is not immediately needed is taken into consideration. For this reason the can inspection station 69 is not located within the can circuit I or Ia according to FIGS. 14 and 15, but in the can circuits II, IIa, III or IIIa, i.e. in the can circuits in which can storage facilities are present.

Figure 16:
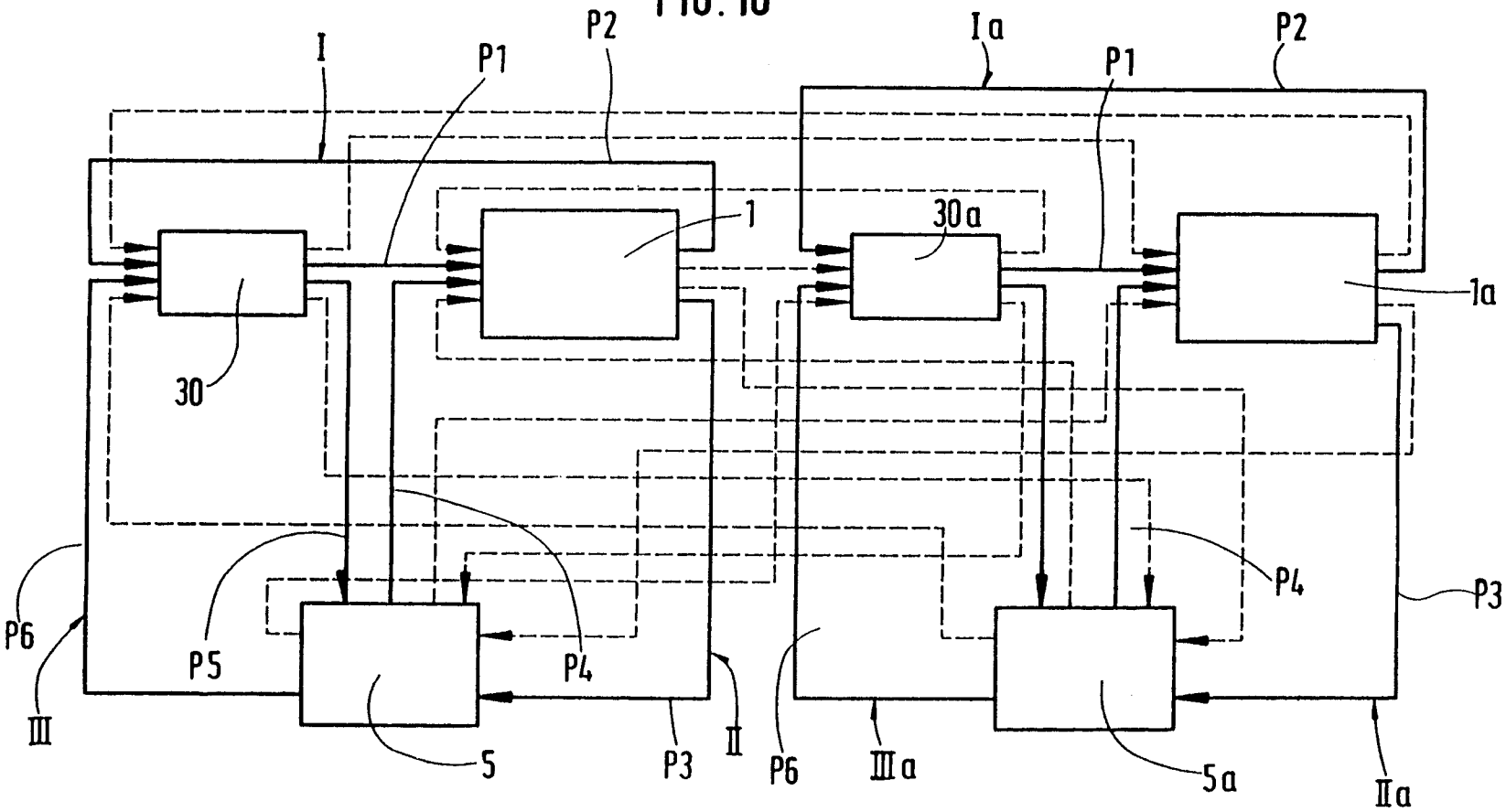

FIG. 16 shows the two installations of FIG. 15 schematically and indicates the first can circuit I or Ia through arrows $P_1$ and $P_2$, the second can circuit II or IIa by means of arrows $P_3$ and $P_3$ and the third can circuit III or IIIa by means of the arrows $P_5$ and $P_6$.

The installation can be operated in such manner that the can conveying device 2 travels to the can inspection station 6 when it is along route 91 and there delivers the can 43 or 44 to the can inspection station 6 for inspection. A can 43 or 44 which has been passed by the can inspection station 6 is then returned immediately to the can conveying device 2.

The can inspection station 6 is, preferably, provided with a can magazine 60 so that when a can 43 or 44, to be inspected, has been delivered to the can inspection station 6, the can conveying device 2 is loaded, out of can magazine 60, with a can 43 or 44 which has previously passed inspection. The can conveying device 2 is then able to return immediately with this can 43 or 44 to a drawing frame 30 or 36 without having to wait at the can inspection station 6.

After inspection the cans 43 or 44 are put into the can magazine 60 to be placed later on a can conveying device 2 or to remain in the can inspection station 6 if they were found to be defective.

Embodiments of can inspection stations 6 shall be described below.

As shown in FIG. 18, the can inspection station 6 is a can weighing device or is equipped with one that is provided with a plate 65 which is supported on the floor via a spring 650. Depending on the extent of fullness of the can (e.g. flat can 44) the plate 65 is depressed and this is indicated in a display device 651. The needle 652 of the display device 651 sweeps over a scale 653, divided into two scale divisions 653*a* and 653*b* as a function of the weight of the can (e.g. flat can 44). While the scale division is swept by the needle 652 for as long as the indicated weight is that of an empty can, the scale division 653*b* is swept when this weight is exceeded because of the presence of sliver remnants in the can (e.g. flat can 44). The arrow 652 and the scale division 653 constitute part of a power circuit (see circuit 654) in a manner not shown here, to which a signal light 655 is connected.

A rotary plate 66 on which it is possible to deposit the can by means of schematically indicated grasping device 728 is installed on the plate 65. The rotary plate 66 is connected in an appropriate manner to a rotating drive 660 which is able to cause the rotary plate 66 to rotate.

A sensor 661 is further provided and is able, in a suitable manner, to scan the upper edge or some other relevant area of the contour of the cans (flat cans 44) and to trigger a signal light 655 via a circuit 662 in case of deviation from a desired value. To inspect the can contour the rotary plate 66 is rotated by means of the rotating drive 660. If necessary, a lifting device can be provided for the rotary plate 66 or the plate 65, so that every point of the can circumference is able to come within range of the sensor 661. This sensor 661 may, of course, be capable of moving vertically (and this is as a rule easier to accomplish) so that the lifting device for the rotary plate 66 or the plate 65 mentioned above may be omitted.

The display device 651 thus serves to indicate a can which is not empty, while the sensor 661 is triggered when the physical condition of the can, and, in the embodiment shown the edge of the can, which is especially important here, is faulty or damaged.

Figure 19:
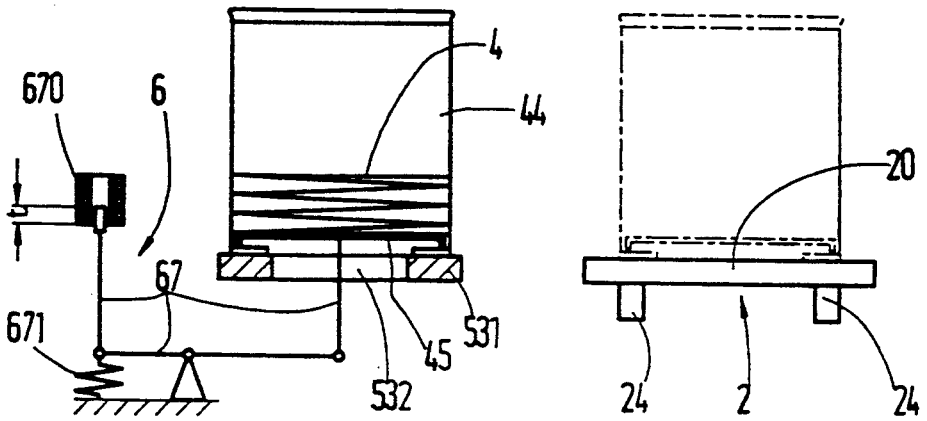

A different embodiment in which the can inspection station 6 is also made in form of a can weighing device is shown in FIG. 19. In this case the can 43 or 44 is equipped with a loose bottom 45 capable of being moved from the outside, vertically in relation to the lateral walls of the can, under the action of a rod system 67, i.e. a lifting bottom. The can stands on a pedestal 531 which has an opening 532 through which part of a rod system 67 extends, the other end of said rod system extending into a bobbin 670. The rod system 67 is part of a lifting device and is subjected to the force of a spring 671 in such manner that the rod system 67 is pressed against the underside of the bottom 45 of the can 44 and tends to lift it up. Depending on the weight of a fiber sliver 4 which may have remained in the can 43 or 44, this succeeds more or less, so that the depth of penetration is a measure of the weight of such sliver remnant. Depending upon the penetration depth of the rod system 67 into the bobbin 670, a signal is produced which may for instance cause a signal light (similar to 655, FIG. 18) to light up.

Such a bottom 45, capable of being lifted through outside action, is also an advantage for stretch-free laying of a fiber sliver 4 into the can 43 or 44 by means of a filling head 31 and during the subsequent, stretch-free withdrawal of the fiber sliver 4.

Figure 20:
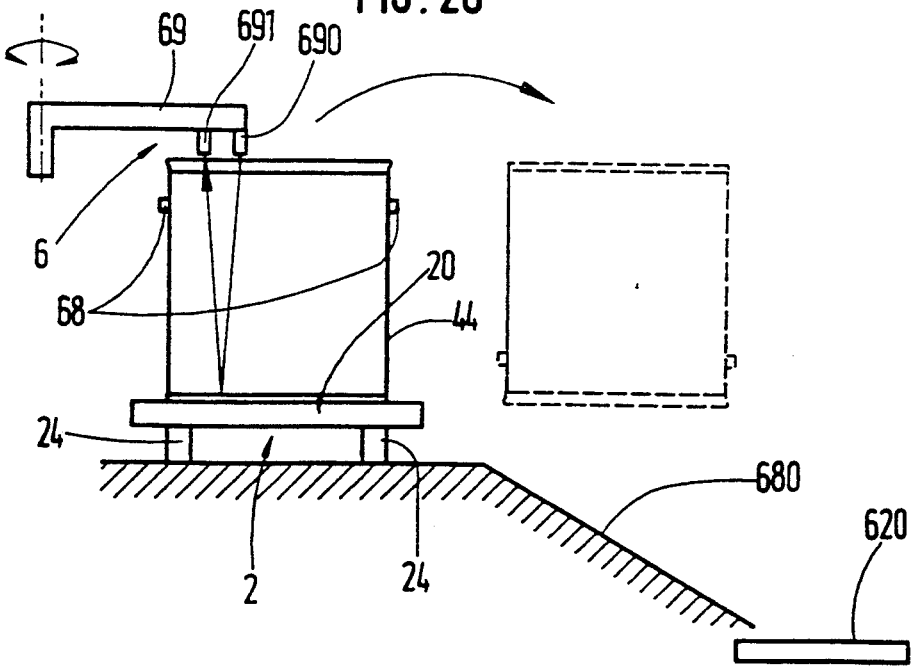
FIG. 20 is a schematic side representation of a can tilting device.

As FIG. 20 shows, it is however also possible to provide a can tilting device 68 which is able to grasp the can 43 or 44, brings it over a ramp 680 by pivoting it and rotates it at the same time by 180° so that its contents is unloaded on the ramp 680 and from there, on to the conveying device 620 which then coneys the emptied fiber sliver remnants to a material collection station 621 (see FIG. 15). The emptied cans may then be conveyed to a filling station 31. Emptying the cans ensures that only one single coherent fiber sliver 4 is present in the cans once they have been filled again.

The can tilting device 68 can be assigned to the can inspection station 6 or to one of the can magazines 601, 602.

Although the can inspection station can be designed as shown in FIGS. 18 or 19 in this embodiment, FIG. 20 shows a different embodiment in which a light source 690 as well as a photoelectric cell 691 capturing light reflected from the bottom of can 44 when the light source 690 is switched on are placed at the end of a horizontally movable pivoting arm 69. The intensity of the reflected light indicates whether the can 44 is empty or not. In addition, if desired, it is also possible to provide for relative movement between the can and the pivot arm 69 with its light source 690 and the photoelectric cell 691. This relative movement can, for example, be produced by an appropriate movement of the arm 69. It is, however, also possible to equip the can tilting device with a friction wheel drive 687 which allows the can to rotate in the friction wheel drive (not shown) so that the scanning device consisting of light source 690 and photoelectric cell 691 is able to scan the bottom of the can over its entire circumference. At the same time this device which scans the can bottom can also be designed so that it detects not only fiber sliver remnants but also damage to the can. If necessary the light source 690 and the photoelectric cell 691 can be adjusted or pivoted in relation to each other and to the pivot arm 69.

As mentioned earlier, it is obvious that the mentioned processes and devices can not only be used or installed between one or several drawing frames 30, 30*a*, 36 or 36*a* and one or several spinning or twisting machines 11, 11*a*, 110, 110*a*, 111, 111*a*, 112, 112*a* or an open-end spinning machine 1, but also in combination with other textile machines putting out fiber slivers (e.g. a card which also has a filling head) or sliver processing machines (e.g. a circular knitting machine, a ring spinning or an air spinning machine).

We claim:

1. A device for transporting fiber sliver cans, which cans have bottoms which can move vertically between side walls of said cans, between a plurality of textile machines for treating or processing fiber slivers, comprising:

(a) a conveying means for conveying a plurality of said cans from one of said machines to another of said machines;

(b) a can receiving point disposed on at least one of said textile machines;

(c) a can delivery point on said one textile machine in close proximity with said can receiving point;

(d) means for moving said conveying means to said receiving point and said delivery point on a machine requiring a fiber sliver can along a predetermined route;

(e) a can inspection station disposed on said conveying means having a lifting means for lifting said can bottoms and weighing the sliver in said cans; and (f) means for transferring a sliver can from said conveying means to said can receiving point and simultaneously transferring a sliver can from said delivery point to said conveying means.

2. A device as set forth in claim 1, further comprising a can shifting device disposed on said can conveying means which is subdivided into a first shifting element for unloading the can and a second shifting element for loading a can onto said can conveying means.

3. A device as set forth in claim 2, wherein said first and second shifting elements are disposed in one and the same plane, which plane is perpendicular to said predetermined route.

4. A device as set forth in claim 2, wherein said conveying means comprises at least two can holding surfaces which are aligned one behind the other in the direction of travel to receive one of said fiber sliver cans on each of said surfaces and said first and second shifting elements are disposed in two planes, each of which are perpendicular to the route of said can conveying means and which are spaced a distance from each other equal to the width of one of said can holding surfaces.

5. A device as set forth in claim 2, wherein said first and second shifting elements are controlled independently of each other.

6. A device as set forth in claim 2, wherein at least one of said first and second can shifting elements is equipped with a grasping device for grasping a fiber sliver can in proximity to the lower end of said can.

7. A device as set forth in claim 6, wherein said fiber sliver cans are provided with a projection at their lower end for interaction with said grasping device.

8. A device as set forth in claim 7, wherein each of said cans has a substantially rectangular cross-section with longer and shorter sides and wherein said projection is at one of the shorter sides of said cans.

9. A device as set forth in claim 8, wherein said cans have a projection at each of said shorter ends.

10. A device as set forth in claim 8, wherein said projection is constructed in the from of a supporting hoop.

11. A device as set forth in claim 2, wherein said can shifting is equipped with a grasping device which is disposed on a sled capable of being shifted in a plane perpendicular to the longitudinal extension of said can conveying means.

12. A device as set forth in claim 11, wherein said sled is disposed on a support sled which is movable in a perpendicular plane to the longitudinal extension of said can conveying means.

13. A device as set forth in claim 2, wherein said can shifting is equipped with a grasping device and a lifting device to lift a can grasped by said grasping device.

14. A device as set forth in claim 2, wherein said can shifting device is disposed on said can conveying means.

15. A device as set forth in claim 14, wherein said can conveying means has two can holding surfaces, each of which is assigned to a separate can shifting device.

16. A device as set forth in claim 2, wherein said can shifting device is selectively movable in two directions perpendicular to said can conveying means for transferring said sliver cans.

17. A device for transporting fiber sliver cans between a plurality of textile machines for treating or processing fiber slivers, comprising:

(a) a can storage facility remote from said textile machines disposed between said textile machines;

(b) a conveying means for conveying a plurality of said cans from one of said machines to another of said machines, said conveying means further comprising a conveying system having three interconnected can circuits whereby a first can circuit connects at least two of said textile machines and the other two can circuits each connect at least of one said textile machines and said remote can storage facility;

(c) a can receiving point disposed on at least one of said textile machines;

(d) a can delivery point on said one textile machine in close proximity with said can receiving point;

(e) means for moving said conveying means to said receiving point and said delivery point of said textile machine; and (f) means for transferring a sliver can from said conveying means to said can receiving point and simultaneously transferring a sliver can from said delivery point to said conveying means.

* * * * *